US009920589B2

(12) United States Patent
Watson et al.

(10) Patent No.: US 9,920,589 B2
(45) Date of Patent: Mar. 20, 2018

(54) METHODS OF COMPLETING A WELL AND APPARATUS THEREFOR

(71) Applicant: THRU TUBING SOLUTIONS, INC., Oklahoma City, OK (US)

(72) Inventors: Brock W. Watson, Sadler, TX (US); Andrew M. Ferguson, Moore, OK (US); Roger L. Schultz, Newcastle, OK (US); Gary P. Funkhouser, Roman Forest, TX (US); Jenna N. Robertson, Norman, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 15/162,334

(22) Filed: May 23, 2016

(65) Prior Publication Data

US 2017/0292343 A1 Oct. 12, 2017

Related U.S. Application Data

(60) Provisional application No. 62/319,056, filed on Apr. 6, 2016.

(51) Int. Cl.
*E21B 33/13* (2006.01)
*E21B 43/11* (2006.01)
(Continued)

(52) U.S. Cl.
CPC ..... *E21B 33/13* (2013.01); *E21B 43/114* (2013.01); *E21B 43/117* (2013.01); *E21B 43/26* (2013.01); *E21B 43/267* (2013.01)

(58) Field of Classification Search
CPC .... E21B 33/13; E21B 33/1208; E21B 33/138; E21B 27/00; E21B 27/02; E21B 27/04
See application file for complete search history.

(56) References Cited

U.S. PATENT DOCUMENTS 2,109,058 A 2/1938 Blee
2,370,833 A 3/1945 Baker
(Continued)

FOREIGN PATENT DOCUMENTS

WO 2007066254 A2 7/2007
WO 2017014820 A1 1/2017

OTHER PUBLICATIONS

"Thread" Merriam-Webster.com. Merriam-Webster, n.d. Web. Feb. 16, 2017, 12 pages.*
(Continued)

*Primary Examiner* — Jennifer H Gay
(74) *Attorney, Agent, or Firm* — Smith IP Services, P.C.

(57) ABSTRACT

A system for use with a well can include a perforating assembly with at least one perforator, the perforating assembly conveyed through a wellbore with fluid flow through the wellbore, and plugging devices spaced apart from the perforating assembly in the wellbore, the plugging devices conveyed through the wellbore with the fluid flow. A method of deploying plugging devices in a wellbore can include conveying a perforating assembly including a dispensing tool through the wellbore, the dispensing tool including a container, and then releasing the plugging devices from the container into the wellbore at a downhole location. Another method of deploying plugging devices in a wellbore can include conveying the plugging devices through the wellbore with fluid flow through the wellbore, and conveying a perforating assembly through the wellbore while the plugging devices are being conveyed through the wellbore.

9 Claims, 15 Drawing Sheets

(51) Int. Cl.

| | |
|---|---|
| ***E21B 43/26*** | (2006.01) |
| ***E21B 43/117*** | (2006.01) |
| ***E21B 43/114*** | (2006.01) |
| *E21B 43/267* | (2006.01) |

(56) References Cited

U.S. PATENT DOCUMENTS 2,621,351 A * 12/1952 Piety ..... E21B 27/02 137/68.13
2,768,693 A 10/1956 Hughes, Jr.
2,788,072 A 4/1957 Goodwin
2,838,117 A 6/1958 Clark, Jr. et al.
2,933,136 A 4/1960 Ayers et al.
2,970,645 A 2/1961 Glass
3,011,548 A * 12/1961 Holt ..... C09K 8/72 166/162
3,028,914 A 4/1962 Flickinger
3,086,587 A * 4/1963 Zandmer ..... E21B 33/138 166/243
3,119,600 A 1/1964 Bitter
3,170,517 A 2/1965 Graham et al.
3,251,993 A 5/1966 Bader et al.
3,292,700 A * 12/1966 Berry ..... E21B 43/261 166/100
3,376,934 A 4/1968 Willman et al.
3,399,726 A 9/1968 Harris et al.
3,417,821 A 12/1968 Tinsley et al.
4,167,139 A 9/1979 Gleason et al.
4,187,909 A * 2/1980 Erbstoesser ..... E21B 27/02 137/268
4,194,561 A * 3/1980 Stokley ..... E21B 17/1021 166/162
4,244,425 A 1/1981 Erbstoesser
4,407,368 A 10/1983 Erbstoesser
4,505,334 A 3/1985 Doner et al.
5,052,489 A * 10/1991 Carisella ..... F42D 1/04 166/297
5,253,709 A 10/1993 Kendrick et al.
5,456,317 A 10/1995 Hood, III et al.
5,507,345 A 4/1996 Wehunt, Jr. et al.
5,908,073 A 6/1999 Nguyen et al.
6,070,666 A 6/2000 Montgomery
6,394,184 B2 5/2002 Tolman et al.
6,543,538 B2 4/2003 Tolman et al.
6,655,475 B1 12/2003 Wald
7,225,869 B2 6/2007 Willet et al.
7,273,099 B2 9/2007 East, Jr. et al.
7,624,810 B2 * 12/2009 Fould ..... E21B 23/04 166/319
7,673,673 B2 3/2010 Surjaatmadja et al.
7,810,567 B2 10/2010 Daniels et al.
7,874,365 B2 1/2011 East, Jr. et al.
7,891,424 B2 2/2011 Creel et al.
8,088,717 B2 1/2012 Polizzotti et al.
8,240,392 B2 8/2012 Barnard et al.
8,281,860 B2 10/2012 Boney et al.
8,307,916 B1 11/2012 Wald
8,505,632 B2 8/2013 Guerrero et al.
8,646,529 B2 2/2014 Clark et al.
8,776,886 B2 7/2014 Rondeau
8,853,137 B2 10/2014 Todd et al.
8,887,803 B2 11/2014 East, Jr. et al.
8,950,438 B2 2/2015 Ryan
9,284,798 B2 3/2016 Jamison et al.
9,523,267 B2 12/2016 Schultz et al.
9,551,204 B2 1/2017 Schultz et al.
9,567,824 B2 2/2017 Watson et al.
9,567,825 B2 2/2017 Schultz et al.
9,567,826 B2 2/2017 Schultz et al.
9,708,883 B2 7/2017 Schultz et al.
2002/0007949 A1 1/2002 Tolman et al.
2004/0129460 A1 7/2004 MacQuoid et al.
2005/0184083 A1 * 8/2005 Diaz ..... E21B 33/138 221/75
2006/0102336 A1 * 5/2006 Campbell ..... E21B 27/02 166/65.1
2006/0113077 A1 6/2006 Willberg et al.
2007/0039739 A1 * 2/2007 Wilson ..... E21B 27/02 166/369
2007/0169935 A1 7/2007 Akbar et al.
2007/0187099 A1 8/2007 Wang
2008/0000639 A1 1/2008 Clark et al.
2008/0196896 A1 8/2008 Bustos et al.
2010/0122813 A1 * 5/2010 Trummer ..... E21B 33/138 166/255.1
2010/0147866 A1 * 6/2010 Witkowski ..... E21B 33/138 221/1
2010/0152070 A1 * 6/2010 Ghassemzadeh ..... C09K 8/035 507/212
2010/0175889 A1 * 7/2010 Gartz ..... E21B 43/1185 166/376
2010/0200235 A1 * 8/2010 Luo ..... C09K 8/50 166/284
2011/0048712 A1 * 3/2011 Barbee ..... E21B 33/05 166/291
2012/0031614 A1 * 2/2012 Rondeau ..... E21B 21/10 166/293
2012/0090835 A1 * 4/2012 Kefi ..... E21B 27/02 166/252.6
2012/0181032 A1 7/2012 Naedler et al.
2012/0285659 A1 11/2012 Lafferty et al.
2012/0285695 A1 * 11/2012 Lafferty ..... C09K 8/03 166/310
2013/0062055 A1 * 3/2013 Tolman ..... E21B 23/00 166/250.01
2013/0186632 A1 7/2013 Makowiecki et al.
2013/0327528 A1 * 12/2013 Frost ..... E21B 37/06 166/304
2013/0341014 A1 12/2013 Trummer et al.
2015/0075793 A1 * 3/2015 Dotson ..... E21B 31/00 166/298
2015/0090453 A1 4/2015 Tolman et al.
2015/0240583 A1 * 8/2015 Mineo ..... E21B 34/063 166/311
2015/0275644 A1 10/2015 Chen et al.
2016/0040520 A1 * 2/2016 Tolman ..... E21B 33/124 166/308.1
2016/0130933 A1 5/2016 Madasu

OTHER PUBLICATIONS

Search Report with Written Opinion dated Feb. 1, 2017 for International Application No. PCT/US16/059476, 17 pages.
U.S. Office Action dated Feb. 1, 2017 for U.S. Appl. No. 15/296,342, 25 pages.
International Search Report with Written Opinion dated Jan. 26, 2016 for PCT Patent Application No. PCT/US15/038248, 16 pages.
Office Action dated Apr. 13, 2016 for U.S. Appl. No. 14/698,578, 27 pages.
Office Action dated Apr. 13, 2016 for U.S. Appl. No. 14/966,812, 27 pages.
"Fabric." Merriam-Webster.com. Merriam-Webster, n.d. Web. Apr. 5, 2016, 6 pages.
"Rope." Merriam-Webster.com. Merriam-Webster, n.d. Web. Apr. 5, 2016, 10 pages.
Specification and drawings for U.S. Appl. No. 15/062,669, filed Mar. 7, 2016, 44 pages.
Specification and drawings for U.S. Appl. No. 15/138,327, filed Apr. 26, 2016, 59 pages.
Specification and drawings for U.S. Appl. No. 15/138,378, filed Apr. 26, 2016, 43 pages.
Specification and drawings for U.S. Appl. No. 15/138,408, filed Apr. 26, 2016, 43 pages.
Specification and drawings for U.S. Appl. No. 15/138,449, filed Apr. 26, 2016, 56 pages.
Specification and drawings for Patent Application No. PCT/US16/29314 filed Apr. 26, 2016, 55 pages.
Specification and drawings for U.S. Appl. No. 15/138,685, filed Apr. 26, 2016, 64 pages.

(56) References Cited

OTHER PUBLICATIONS

Specification and drawings for U.S. Appl. No. 15/138,968, filed Apr. 26, 2016, 107 pages.
Specification and drawings for U.S. Appl. No. 14/698,578, filed Apr. 28, 2015, 36 pages.
Specification and drawings for Patent Application No. PCT/US16/29357 filed Apr. 26, 2016, 50 pages.
Specification and drawings for Patent Application No. PCT/US15/38248 filed Jun. 29, 2015, 39 pages.
Monosol; "Film Data Sheet", product information brochure, dated Mar. 6, 2012, 1 page.
Specification and drawings for U.S. Appl. No. 15/296,342, filed Oct. 18, 2016, 120 pages.
Specification and drawings for PCT Patent Application No. PCT/US16/57514, filed Oct. 18, 2016, 120 pages.
Office Action dated May 5, 2017 for U.S. Appl. No. 15/347,535, 20 pages.
Office Action dated May 9, 2017 for U.S. Appl. No. 15/138,685, 42 pages.
Office Action dated May 12, 2017 for U.S. Appl. No. 15/296,342, 23 pages.
Office Action dated Jul. 11, 2017 for U.S. Appl. No. 15/622,016, 16 pages.
Office Action dated Jul. 13, 2017 for U.S. Appl. No. 15/615,136, 13 pages.
Office Action dated Jul. 14, 2017 for U.S. Appl. No. 15/391,014, 24 pages.
Office Action dated Jul. 17, 2017 for U.S. Appl. No. 15/138,685, 21 pages.
"Yarn"; Definition of Yarn by Merriam-Webster.com, Merrian-Webster, n.d. Web., Aug. 11, 2017, 6 pages.
Specification and Drawings for U.S. Appl. No. 15/567,779, filed Oct. 19, 2017, 63 pages.
Office Action dated Nov. 3, 2017 for U.S. Appl. No. 15/138,685, 15 pages.
Office Action dated Nov. 7, 2017 for U.S. Appl. No. 15/162,334, 16 pages.
Office Action dated Nov. 13, 2017 for U.S. Appl. No. 15/622,016, 44 pages.
Office Action dated Nov. 13, 2017 for U.S. Appl. No. 15/615,136, 34 pages.
Examiner's Answer dated Nov. 15, 2017 for U.S. Appl. No. 15/347,535, 14 pages.

* cited by examiner

METHODS OF COMPLETING A WELL AND APPARATUS THEREFOR

CROSS-REFERENCE TO RELATED APPLICATION

This application claims the benefit of the filing date of U.S. provisional application Ser. No. 62/319,056 filed on 6 Apr. 2016. The entire disclosure of this prior application is incorporated herein by this reference.

BACKGROUND

This disclosure relates generally to equipment utilized and operations performed in conjunction with a subterranean well and, in one example described below, more particularly provides for plugging devices and their deployment in wells.

It can be beneficial to be able to control how and where fluid flows in a well. For example, it may be desirable in some circumstances to be able to prevent fluid from flowing into a particular formation zone. As another example, it may be desirable in some circumstances to cause fluid to flow into a particular formation zone, instead of into another formation zone. As yet another example, it may be desirable to temporarily prevent fluid from flowing through a passage of a well tool. Therefore, it will be readily appreciated that improvements are continually needed in the art of controlling fluid flow in wells.

DETAILED DESCRIPTION

Figure 1:
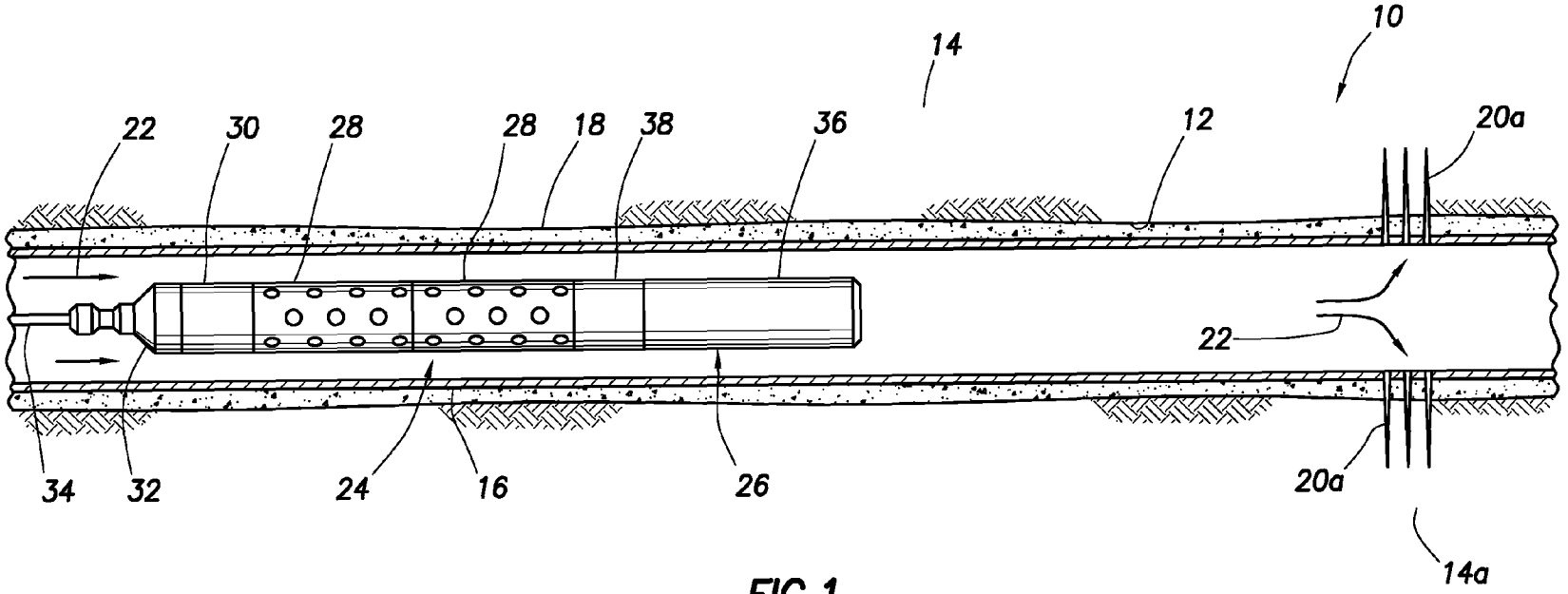
FIG. 1 is a representative partially cross-sectional view of an example of a well system and associated method which can embody principles of this disclosure, wherein a perforating assembly is being displaced into a well.

Example methods described below allow existing fluid passageways to be blocked permanently or temporarily in a variety of different applications. Certain flow conveyed plugging device examples described below are made of a fibrous material and may comprise a central body, a "knot" or other enlarged geometry.

The devices may be conveyed into the passageways or leak paths using pumped fluid. Fibrous material extending outwardly from a body of a device can "find" and follow the fluid flow, pulling the enlarged geometry or fibers into a restricted portion of a flow path, causing the enlarged geometry and additional strands to become tightly wedged into the flow path, thereby sealing off fluid communication.

The devices can be made of degradable or non-degradable materials. The degradable materials can be either self-degrading, or can require degrading treatments, such as, by exposing the materials to certain acids, certain base compositions, certain chemicals, certain types of radiation (e.g., electromagnetic or "nuclear"), or elevated temperature. The exposure can be performed at a desired time using a form of well intervention, such as, by spotting or circulating a fluid in the well so that the material is exposed to the fluid.

In some examples, the material can be an acid degradable material (e.g., nylon, etc.), a mix of acid degradable material (for example, nylon fibers mixed with particulate such as calcium carbonate), self-degrading material (e.g., poly-lactic acid (PLA), poly-glycolic acid (PGA), etc.), material that degrades by galvanic action (such as, magnesium alloys, aluminum alloys, etc.), a combination of different self-degrading materials, or a combination of self-degrading and non-self-degrading materials.

Multiple materials can be pumped together or separately. For example, nylon and calcium carbonate could be pumped as a mixture, or the nylon could be pumped first to initiate a seal, followed by calcium carbonate to enhance the seal.

In certain examples described below, the device can be made of knotted fibrous materials. Multiple knots can be used with any number of loose ends. The ends can be frayed or un-frayed. The fibrous material can be rope, fabric, metal wool, cloth or another woven or braided structure.

The device can be used to block open sleeve valves, perforations or any leak paths in a well (such as, leaking connections in casing, corrosion holes, etc.). Any opening or passageway through which fluid flows can be blocked with a suitably configured device. For example, an intentionally or inadvertently opened rupture disk, or another opening in a well tool, could be plugged using the device.

Previously described plugging devices can be used in the methods described herein, along with several different apparatuses and methods for deploying and placing the plugging devices at desired locations within the well. Descriptions of fibrous and/or degradable plugging devices are in U.S. application Ser. No. 14/698,578 (filed 28 Apr. 2015), 62/195,078 (filed 21 Jul. 2015), 62/243,444 (filed 19 Oct. 2015) and 62/252,174 (filed 6 Nov. 2015), and in International application no. PCT/US15/38248 (filed 29 Jun. 2015). The entire disclosures of these prior applications are incorporated herein by this reference.

In one example method described below, a well with an existing perforated zone can be re-completed. Devices (either degradable or non-degradable) are conveyed by flow to plug all existing perforations.

The well can then be re-completed using any desired completion technique. If the devices are degradable, a degrading treatment can then be placed in the well to open up the plugged perforations (if desired).

In another example method described below, multiple formation zones can be perforated and fractured (or otherwise stimulated, such as, by acidizing) in a single trip of a bottom hole assembly into the well. In the method, one zone is perforated, the zone is stimulated, and then the perforated zone is plugged using one or more devices.

These steps are repeated for each additional zone, except that a last zone may not be plugged. All of the plugged zones are eventually unplugged by waiting a certain period of time (if the devices are self-degrading), by applying an appropriate degrading treatment, or by mechanically removing the devices.

In another example, flow of fluid into previously fractured zones is blocked using flow conveyed plugging devices instead of a drillable plug. The plugging devices are carried into a wellbore via a tool in a perforating assembly. The plugging devices are then released in the wellbore. The method generally consists of the following steps:

1. Establish a flow path through the wellbore (for example, by providing one or more openings at a "toe" or distal end of the wellbore, e.g., via coiled tubing perforations, a pressure operated toe valve, a wet shoe, etc.), so fluid can be pumped through the wellbore, allowing the perforating assembly to be pumped down the cased wellbore.
2. Pump the perforating assembly to above (less depth along the wellbore) the topmost open perforations in the wellbore. The perforating assembly includes (from bottom to top) a plugging device dispensing tool, one or more perforators, a controller/firing head, and a connector for a conveyance used to convey the assembly into the wellbore.
3. Operate an actuator of the plugging device dispensing tool to release the plugging devices into the wellbore above the topmost open perforations. The actuator may be operated using various techniques, such as, electrically, hydraulically, by pipe manipulation, by applying set down weight, by igniting a propellant, by detonating an explosive, etc.
4. Move the perforating assembly up hole to one or more additional desired locations (to shallower depths along the wellbore) and operate perforators to create perforations at the one or more locations within the cased wellbore. If jointed or coiled tubing is used to convey the perforating assembly, the controller/firing head may be pressure actuated to detonate explosive shaped charges of the perforator, or an abrasive jet perforator may be used.
5. Retrieve the perforating assembly from the wellbore.
6. Perform fracturing operations to fracture the formation(s) penetrated by the open perforations, and deliver sand slurry (e.g., proppant) to fractured formation(s).
7. Pump "flush" of sand-free fluid from surface to push any remaining sand out of the wellbore and into the fractured formation(s) via the open perforations.
8. Repeat steps 2-7 until all desired zones are fractured.

The above method can also be used in conjunction with a conventional "plug and perf" technique, in which drillable bridge plugs are installed in a cased wellbore above previously fractured zone(s).

The plugging device dispensing tool used to convey the plugging devices into the wellbore can comprise a canister or other container which is loaded with plugging devices and conveyed into the well with the perforating assembly. Of course, any means of conveyance can be used to convey the perforating assembly (for example, wireline, coiled tubing, jointed pipe, slickline, etc.).

Some suitable embodiments and methods for carrying plugging devices into the wellbore are listed below. In addition, any of the methods and dispensing apparatuses described in U.S. patent application Ser. No. 15/138,968, filed 26 Apr. 2016, may be used. The entire disclosure of this prior application is incorporated herein by this reference for all purposes.

1. In one example, the plugging devices are dispensed using an auger type element driven by an electric motor. In this example, the number of devices dispensed is dependent on the run time and speed of the electric motor, and a configuration of the auger.
2. In another example, the plugging devices are carried in a tube with a frangible disk closing off a bottom of the tube. The disk can be broken so that fluid pumped past the dispensing tool, or upward movement of the dispensing tool, creates a pressure differential to push the plugging devices out of the tool. The disk can be broken using:
   a. Pyrotechnic explosive (for instance a blasting cap or detonator as used in dump bailers).
   b. Fluid pressure generated by the dispensing tool.
   c. Mechanical impact caused by the dispensing tool.
   d. Any other shock-inducing or cutting action.
3. In another example, the plugging device dispensing tool comprises a canister or chamber having an initially closed opening or valve which can be mechanically operated to an open position. In the open position, the plugging devices are allowed to exit from the canister or chamber. The plugging devices can be forcibly discharged, or a pressure differential can be generated across the canister/chamber by pumping fluid past the tool, or the tool can be moved within the wellbore. The opening can be anywhere on the tool, such as, at the bottom, or along a side of the canister.
4. In another example, the plugging devices are dispensed in a "slurry" which is pumped from the dispensing tool to the wellbore using an electrically driven pump.
5. Some of the dispensing tool examples described above can be adapted to use a standard bridge plug setting tool as the motive means to operate the dispensing tool. This would allow widely used, industry standard setting tools to be used with little or no modification to operate the dispensing tool(s). In this case, the plugging device dispensing tool will have a mechanical interface which is practically identical to industry standard drillable bridge plugs.

In another method, flow of fluid into previously fractured zones is blocked using flow conveyed plugging devices, instead of a drillable bridge plug. The plugging devices are pumped from the surface into the wellbore ahead of the perforating assembly, and as the perforating assembly is being pumped through the wellbore.

The perforating assembly is stopped above open perforations that were fractured in a previous stage, or another opening that provides for flow through the wellbore. The plugging devices are pumped beyond the perforating assembly location and into the open perforations or other openings to block flow into the perforations or openings during the next fracturing step. The method generally consists of the following steps:

1. Establish a flow path through the wellbore (for example, by providing one or more openings at a "toe" or distal end of the wellbore, e.g., via coiled tubing perforations, a pressure operated toe valve, a wet shoe, etc.), so fluid can be pumped through the wellbore, allowing the perforating assembly to be pumped down the cased wellbore.
2. Pump plugging devices from surface into the wellbore slightly ahead of the perforating assembly.
3. Pump perforating assembly to above the topmost open perforations or other openings in the wellbore, while at the same time pumping plugging devices just ahead of the perforating assembly. The perforating assembly can include (from bottom to top) one or more perforators, a controller/firing head, and a connector for a conveyance used to convey the assembly into the wellbore.
4. While holding the perforating assembly in place above the open perforations or other openings, continue pumping the plugging devices further into the wellbore until they land in the open perforations or openings below the perforating assembly and block further flow into the perforations or openings.
5. Move the perforating assembly up hole to one or more additional desired locations (to shallower depths along the wellbore) and operate perforators to create perforations at the one or more locations within the cased wellbore. If jointed or coiled tubing is used to convey the perforating assembly, the controller/firing head may be pressure actuated to detonate explosive shaped charges of the perforator, or an abrasive jet perforator may be used.
6. Retrieve the perforating assembly from the wellbore.
7. Perform fracturing operations to fracture the formation(s) penetrated by the open perforations, and deliver sand slurry (e.g., proppant) to fractured formation(s).
8. Repeat steps 2-7 until all desired zones are fractured.

The above method can also be used in conjunction with a conventional "plug and perf" technique, in which drillable bridge plugs are installed in a cased wellbore above previously fractured zone(s).

After a wellbore is completed using any of the methods described herein, the plugging devices may be removed in any of a number of ways including:

a. Mechanical removal with a drilling assembly including a fluid motor conveyed on tubing.
b. Mechanical removal with a gauge ring conveyed on tubing.
c. Mechanical removal with a drilling assembly rotated from surface.
d. Chemical removal by applying a degrading treatment (such as acid) "spotted" through tubing, or pumped from the surface.
e. Waiting a prescribed amount of time if self-degrading plugging devices are used.

Note that none of the methods described herein are limited to hydraulic fracturing. They can also be applied to matrix treatments, such as matrix acidizing (carbonate or sandstone formations), and damage removal (e.g., scale, mud filtrate) with acid or chelants. Any type of stimulation treatment may be performed, instead of or in addition to fracturing, in keeping with the principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled so that it penetrates an earth formation 14. The wellbore 12 is lined with casing 16 and cement 18, although in other examples one or more sections of the wellbore may be uncased or open hole.

The wellbore 12 as depicted in FIG. 1 is generally horizontal, and a "toe" or distal end of the wellbore is to the right of the figure. However, in other examples, the wellbore 12 could be generally vertical or inclined relative to vertical.

As used herein, the terms "above," "upward" and similar terms are used to refer to a direction toward the earth's surface along the wellbore 12, whether the wellbore is generally horizontal, vertical or inclined. Thus, in the FIG. 1 example, the upward direction is toward the left of the figure.

As depicted in FIG. 1, a set of perforations 20*a* have been formed through the casing 16, cement 18 and into a zone 14*a* of the formation 14. The perforations 20*a* provide for fluid communication between the zone 20*a* and an interior of the casing 16. Such fluid communication could be otherwise provided, such as, by use of a sliding sleeve valve (not shown) or other openings or ports through the casing 16.

The perforations 20*a* (or other openings) may be provided or formed in order to establish such fluid communication, so that a flow path extends longitudinally through the wellbore 12 and into the zone 14*a*. In some examples, the perforations 20*a* may be formed primarily to enable production flow from the zone 14*a* to the earth's surface via the wellbore 12.

The perforations 20*a* may be formed using any suitable technique, such as, perforating by explosive shaped charges or by discharge of an abrasive jet, or the perforations may exist in the casing 16 prior to the casing being installed in the wellbore 12 (for example, a perforated liner could be installed as part of the casing). Thus, the scope of this disclosure is not limited to any particular timing or technique for forming the perforations 20*a*.

In some examples, openings other than perforations may be available in the well for enabling fluid flow through the wellbore 12. Tools known to those skilled in the art as a "wet shoe" or a "toe valve" can provide openings at the distal end of the wellbore 12. Thus, the scope of this disclosure is not limited to any particular means of providing for fluid flow through the wellbore 12.

Note that it is not necessary in keeping with the principles of this disclosure for the perforations 20*a* or other openings to be formed at or near a distal end of the wellbore 12, or for any other procedures or steps described herein to be performed at or near a distal end of a wellbore.

In the FIG. 1 example, a fluid flow 22 is established longitudinally through the wellbore 12, outward through the perforations 20*a* and into the zone 14*a*. This fluid flow 22 is used to displace or "pump" a perforating assembly 24 through the wellbore 12. Note that the zone 14*a* may have been treated (for example, by acidizing, fracturing, injection of conformance agents, etc.) prior to establishing the fluid flow 22, or the fluid flow could be part of treating the zone 14*a*.

As depicted in FIG. 1, the perforating assembly 24 includes a plugging device dispensing tool 26, two perforators 28, a firing head 30, and a connector 32. The connector 32 is used to connect the perforating assembly 24 to a conveyance 34, such as, a wireline, a slickline, coiled tubing or jointed tubing.

The dispensing tool 26 in this example includes a container 36 and an actuator 38. The container 36 contains the plugging devices (not visible in FIG. 1, see FIG. 2), and the actuator 38 acts to release the plugging devices from the container in the wellbore 12.

Several examples of the container 36 and actuator 38 are depicted in FIGS. 14-18 and described more fully below. In addition, any of the methods and dispensing apparatuses described in the U.S. patent application Ser. No. 15/138,968 mentioned above may be used for the container 36 and actuator 38.

The perforators 28 are depicted in FIG. 1 as being explosive shaped charge perforating guns. Shaped charges in the perforating guns are detonated by means of the firing head 30, which may be operated in response to a predetermined pressure, pressure pulse, acoustic, electric, hydraulic, optical or other type of signal.

Alternatively, the perforators 28 could comprise one or more abrasive jet perforators (for example, if the conveyance 34 is a coiled or jointed tubing). The scope of this disclosure is not limited to use of any particular type of perforator.

The fluid flow 22 displaces the perforating assembly 24 through the wellbore 12 to a desired location. In this example, the desired location is a position above the perforations 20*a*. In other examples, gravity or another source of a biasing force could be used to displace the perforating assembly 24 through the wellbore 12 (e.g., if the wellbore is vertical or inclined, or if a downhole tractor is used), and/or the perforating assembly may be displaced to another desired location.

Figure 2:
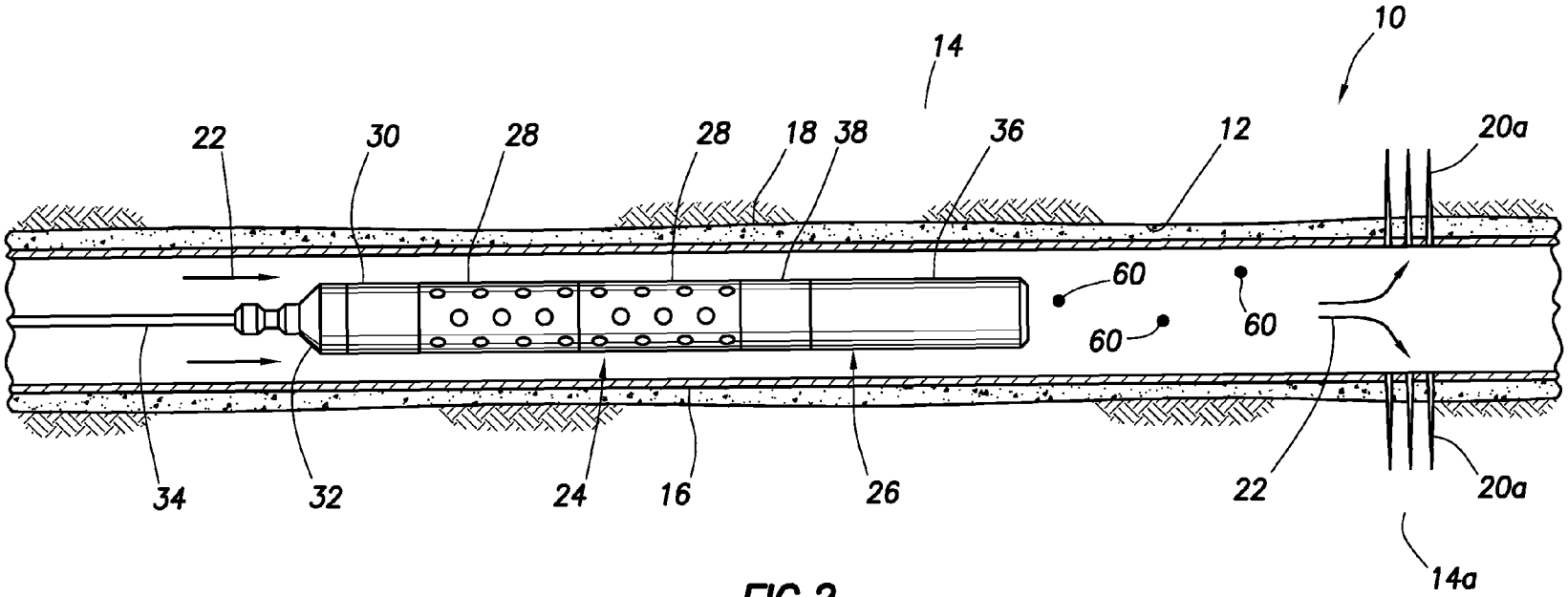
FIG. 2 is a representative partially cross-sectional view of the system and method of FIG. 1, wherein flow conveyed plugging devices are being released from a container of the perforating assembly.

Referring additionally now to FIG. 2, the system 10 and method are representatively illustrated after the perforating assembly 24 has been displaced to the desired location above the open perforations 20*a*, and the dispensing tool 26 has been operated to release the plugging devices 60 into the wellbore above the perforations. The fluid flow 22 displaces the plugging devices 60 through the wellbore 12 toward the open perforations 20*a*.

Any number of the plugging devices 60 may be released from the tool 26. In various examples, the number of plugging devices 60 released could be equal to, less than, or greater than, the number of open perforations 20*a*.

An equal number of open perforations 20*a* and plugging devices 60 may be used if it is desired to plug all of the perforations and not have excess plugging devices remaining in the wellbore 12. A greater number of plugging devices 60 may be used if it is desired to ensure that there are more than an adequate number of plugging devices to plug all of the perforations 20*a*. A fewer number of plugging devices 60 may be used if it is desired to maintain a capability for flowing fluid downward through the wellbore 12 after most of the perforations 20*a* have been plugged.

Figure 3:
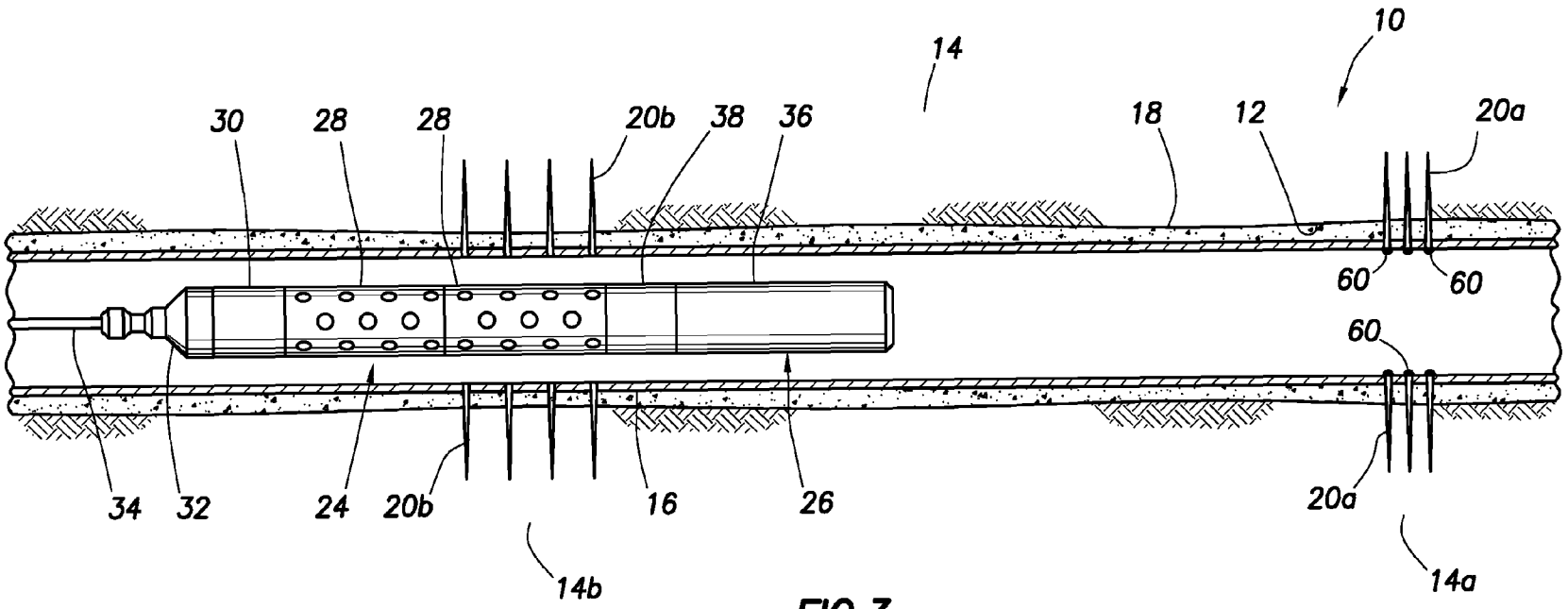
FIG. 3 is a representative partially cross-sectional view of the system and method, wherein a formation zone is perforated.

Referring additionally now to FIG. 3, the system 10 and method are representatively illustrated after the plugging devices 60 have sealingly engaged and prevent fluid flow into the perforations 20*a*. The perforating assembly 24 has been raised in the wellbore 12 to another location where it is desired to perforate another zone 14*b* of the formation 14, and perforations 20*b* have been formed through the casing 16 and cement 18 by the perforating assembly.

Fluid communication is now permitted between the zone 14*b* and the interior of the casing 16. Additional perforations may be formed at other locations along the wellbore 12 using the perforating assembly 24, if desired. The perforating assembly 24 can then be retrieved from the wellbore 12, and the zone 14*b* (and any other perforated zone(s)) can be treated (for example, by fracturing, acidizing, injection of conformance agents, etc.).

The steps described above and depicted in FIGS. 1-3 can be repeated multiple times, until all desired zones have been perforated and treated. At that point, the plugging devices 60 can be degraded or otherwise removed from the perforations or other openings, so that fluid communication is permitted between the various zones and the interior of the casing 16.

Figure 4A:
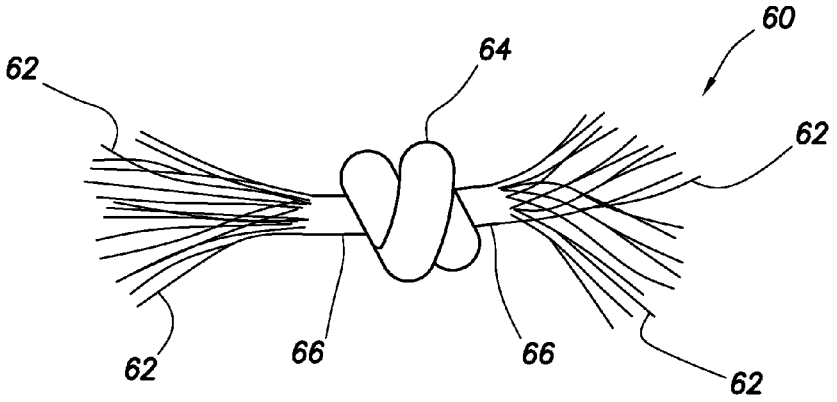
FIGS. 4A & B are enlarged scale representative elevational views of examples of a flow conveyed plugging device that may be used in the system and method of FIGS. 1-3, and which can embody the principles of this disclosure.

Referring additionally now to FIG. 4A, an example of a flow conveyed plugging device 60 that can incorporate the principles of this disclosure is representatively illustrated. The device 60 may be used for any of the plugging devices in the method examples described herein, or the device may be used in other methods.

The device 60 example of FIG. 4A includes multiple fibers 62 extending outwardly from an enlarged body 64. As depicted in FIG. 4A, each of the fibers 62 has a lateral dimension (e.g., a thickness or diameter) that is substantially smaller than a size (e.g., a thickness or diameter) of the body 64.

The body 64 can be dimensioned so that it will effectively engage and seal off a particular opening in a well. For example, if it is desired for the device 60 to seal off a perforation in a well, the body 64 can be formed so that it is somewhat larger than a diameter of the perforation. If it is desired for multiple devices 60 to seal off multiple openings having a variety of dimensions (such as holes caused by corrosion of the casing 16), then the bodies 64 of the devices can be formed with a corresponding variety of sizes.

In the FIG. 4A example, the fibers 62 are joined together (e.g., by braiding, weaving, cabling, etc.) to form lines 66 that extend outwardly from the body 64. In this example, there are two such lines 66, but any number of lines (including one) may be used in other examples.

The lines 66 may be in the form of one or more ropes, in which case the fibers 62 could comprise frayed ends of the rope(s). In addition, the body 64 could be formed by one or more knots in the rope(s). In some examples, the body 64 can comprise a fabric or cloth, the body could be formed by one or more knots in the fabric or cloth, and the fibers 62 could extend from the fabric or cloth.

In other examples, the device 60 could comprise a single sheet of material, or multiple strips of sheet material. The device 60 could comprise one or more films. The body 64 and lines 66 may not be made of the same material, and the body and/or lines may not be made of a fibrous material.

In the FIG. 4A example, the body 64 is formed by a double overhand knot in a rope, and ends of the rope are frayed, so that the fibers 62 are splayed outward. In this manner, the fibers 62 will cause significant fluid drag when the device 60 is deployed into a flow stream, so that the device will be effectively "carried" by, and "follow," the flow.

However, it should be clearly understood that other types of bodies and other types of fibers may be used in other examples. The body 64 could have other shapes, the body could be hollow or solid, and the body could be made up of one or multiple materials. The fibers 62 are not necessarily joined by lines 66, and the fibers are not necessarily formed by fraying ends of ropes or other lines. The body 64 is not necessarily centrally located in the device 60 (for example, the body could be at one end of the lines 66). Thus, the scope of this disclosure is not limited to the construction, configuration or other details of the device 60 as described herein or depicted in the drawings.

Figure 4B:
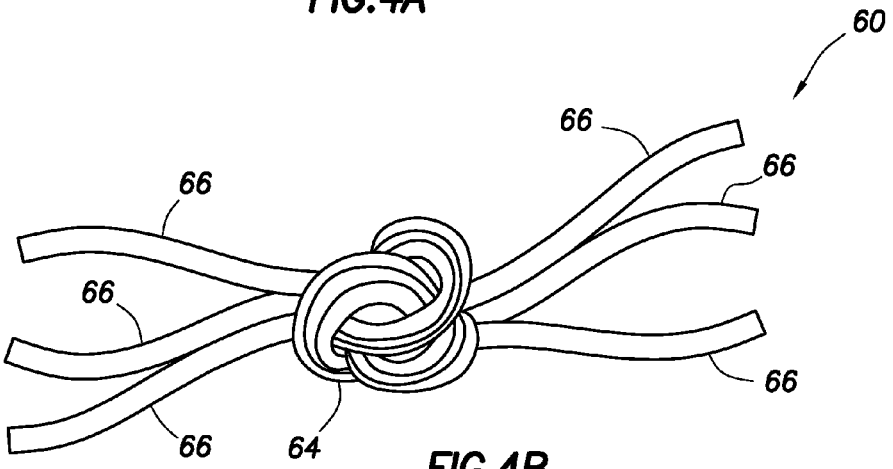

Referring additionally now to FIG. 4B, another example of the device 60 is representatively illustrated. In this example, the device 60 is formed using multiple braided lines 66 of the type known as "mason twine." The multiple lines 66 are knotted (such as, with a double or triple overhand knot or other type of knot) to form the body 64. Ends of the lines 66 are not necessarily frayed in these examples, although the lines do comprise fibers (such as the fibers 62 described above).

Figure 5:
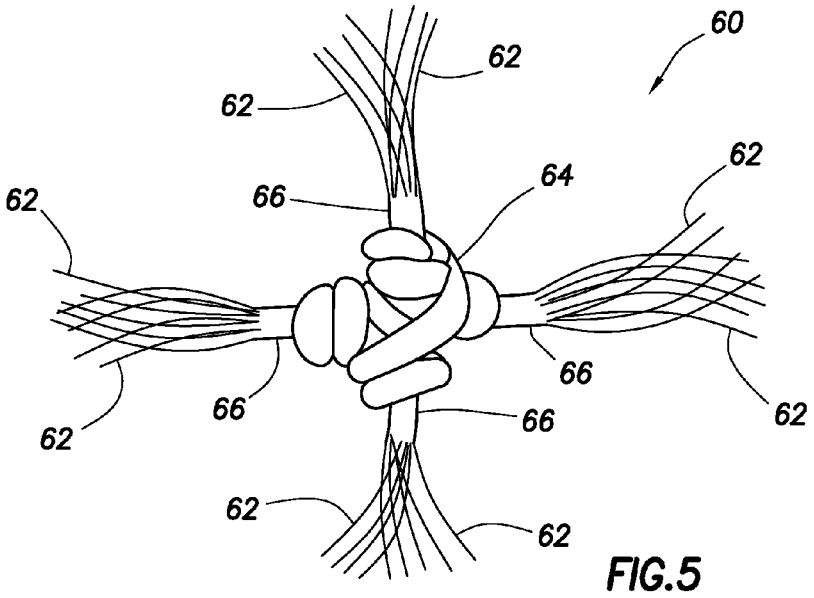
FIG. 5 is a representative elevational view of another example of the flow conveyed plugging device.

Referring additionally now to FIG. 5, another example of the device 60 is representatively illustrated. In this example, four sets of the fibers 62 are joined by a corresponding number of lines 66 to the body 64. The body 64 is formed by one or more knots in the lines 66.

FIG. 5 demonstrates that a variety of different configurations are possible for the device 60. Accordingly, the principles of this disclosure can be incorporated into other configurations not specifically described herein or depicted in the drawings. Such other configurations may include fibers joined to bodies without use of lines, bodies formed by techniques other than knotting, etc.

Figure 6B:
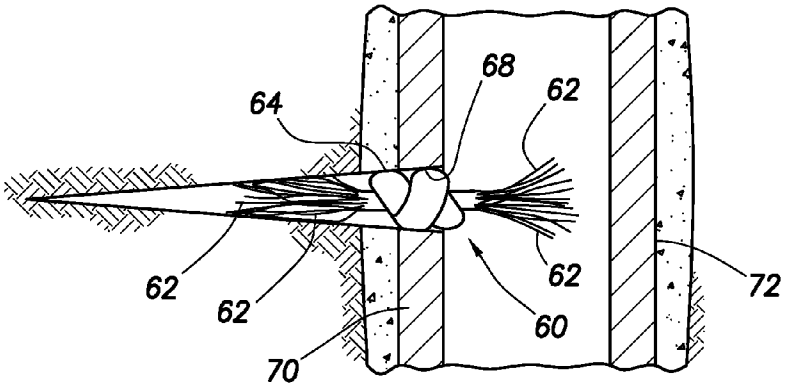
FIGS. 6A & B are representative partially cross-sectional views of the flow conveyed plugging device in a well, the device being conveyed by flow in FIG. 6A, and engaging a casing opening in FIG. 6B.
Figure 6A:
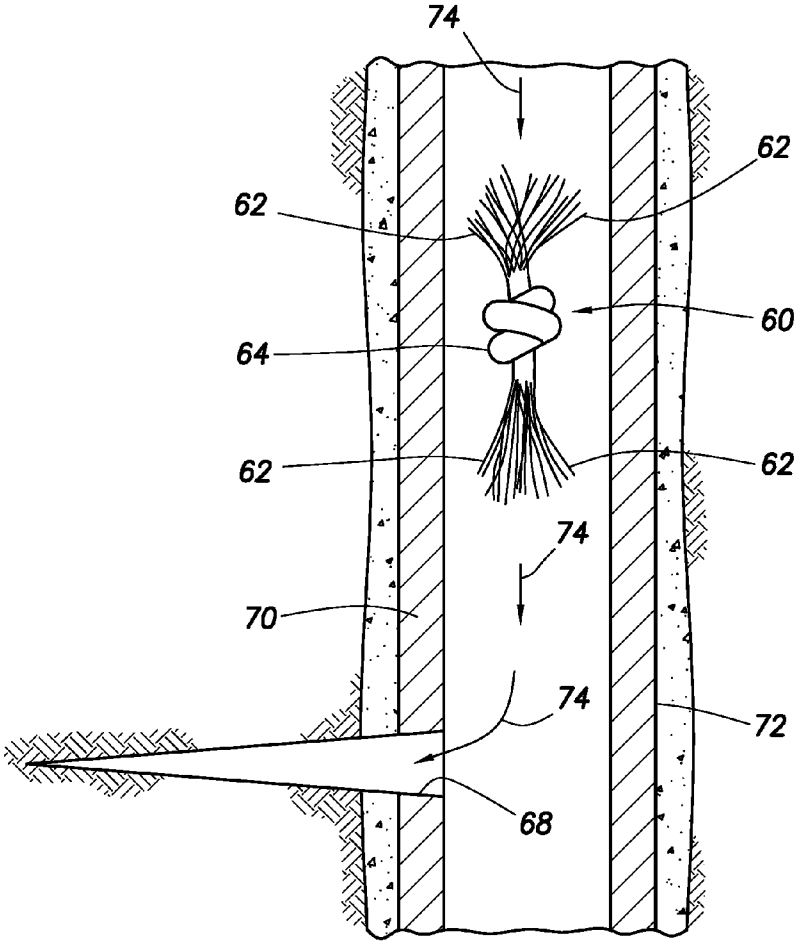

Referring additionally now to FIGS. 6A & B, an example of a use of the device 60 of FIG. 4A to seal off an opening 68 in a well is representatively illustrated. In this example, the opening 68 is a perforation formed through a sidewall 70 of a tubular string 72 (such as, a casing, liner, tubing, etc.). However, in other examples the opening 68 could be another type of opening, and may be formed in another type of structure.

The device 60 is deployed into the tubular string 72 and is conveyed through the tubular string by fluid flow 74. The fibers 62 of the device 60 enhance fluid drag on the device, so that the device is influenced to displace with the flow 74.

The fluid flow 74 may be the same as, or similar to, the fluid flow 22 described above for the example of FIGS. 1-3. However, the fluid flow 74 could be another type of fluid flow, in keeping with the principles of this disclosure.

Since the flow 74 (or a portion thereof) exits the tubular string 72 via the opening 68, the device 60 will be influenced by the fluid drag to also exit the tubular string via the opening 68. As depicted in FIG. 6B, one set of the fibers 62 first enters the opening 68, and the body 64 follows. However, the body 64 is appropriately dimensioned, so that it does not pass through the opening 68, but instead is lodged or wedged into the opening. In some examples, the body 64 may be received only partially in the opening 68, and in other examples the body may be entirely received in the opening.

The body 64 may completely or only partially block the flow 74 through the opening 68. If the body 64 only partially blocks the flow 74, any remaining fibers 62 exposed to the flow in the tubular string 72 can be carried by that flow into any gaps between the body and the opening 68, so that a combination of the body and the fibers completely blocks flow through the opening.

In another example, the device 60 may partially block flow through the opening 68, and another material (such as, calcium carbonate, poly-lactic acid (PLA) or poly-glycolic acid (PGA) particles) may be deployed and conveyed by the flow 74 into any gaps between the device and the opening, so that a combination of the device and the material completely blocks flow through the opening.

The device 60 may permanently prevent flow through the opening 68, or the device may degrade to eventually permit flow through the opening. If the device 60 degrades, it may be self-degrading, or it may be degraded in response to any of a variety of different stimuli. Any technique or means for degrading the device 60 (and any other material used in conjunction with the device to block flow through the opening 68) may be used in keeping with the scope of this disclosure.

In other examples, the device 60 may be mechanically removed from the opening 68. For example, if the body 64 only partially enters the opening 68, a mill or other cutting device may be used to cut the body from the opening. Some techniques for degrading or otherwise removing the device 60 are representatively illustrated in FIGS. 22-24, and are described more fully below.

Figure 7:
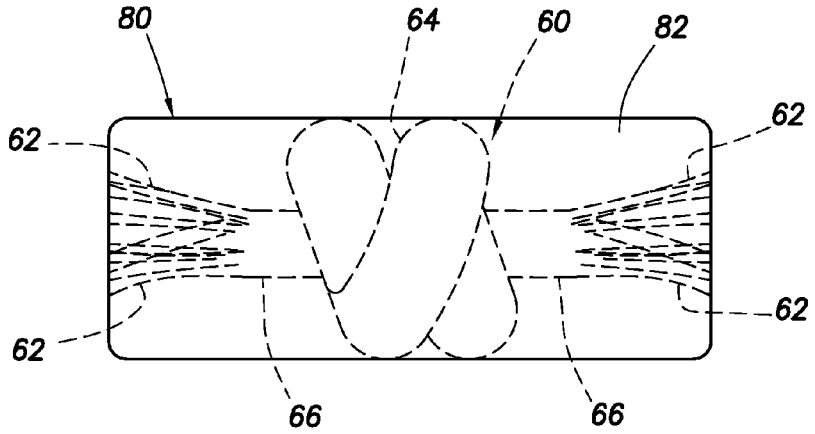
FIGS. 7-9 are representative elevational views of examples of the flow conveyed plugging device with a retainer.
Figure 8:
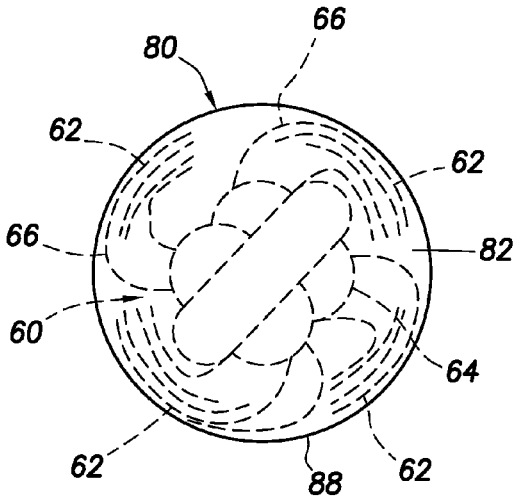
Figure 9:
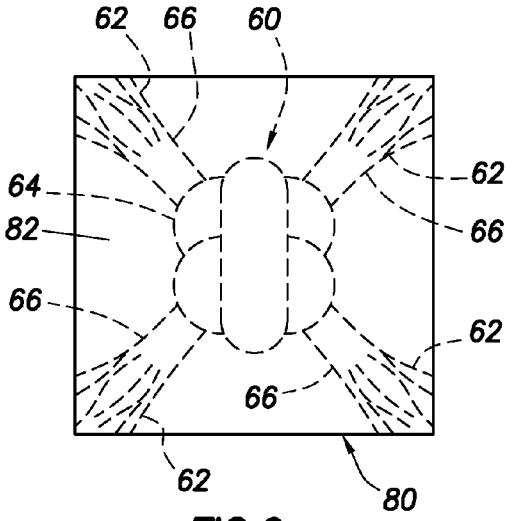

Referring additionally now to FIGS. 7-9, additional examples of the device 60 are representatively illustrated. In these examples, the device 60 is surrounded by, encapsulated in, molded in, or otherwise retained by, a retainer 80.

The retainer 80 aids in deployment of the device 60, particularly in situations where multiple devices are to be deployed simultaneously. In such situations, the retainer 80 for each device 60 prevents the fibers 62 and/or lines 66 from becoming entangled with the fibers and/or lines of other devices.

The retainer 80 could in some examples completely enclose the device 60. In other examples, the retainer 80 could be in the form of a binder that holds the fibers 62 and/or lines 66 together, so that they do not become entangled with those of other devices.

In some examples, the retainer 80 could have a cavity therein, with the device 60 (or only the fibers 62 and/or lines 66) being contained in the cavity. In other examples, the retainer 80 could be molded about the device 60 (or only the fibers 62 and/or lines 66).

During or after deployment of the device 60 into the well, the retainer 80 dissolves, melts, disperses or otherwise degrades, so that the device is capable of sealing off an opening 68 in the well, as described above. For example, the retainer 80 can be made of a material 82 that degrades in a wellbore environment.

The retainer material 82 may degrade after deployment into the well, but before arrival of the device 60 at the opening 68 to be plugged. In other examples, the retainer material 82 may degrade at or after arrival of the device 60 at the opening 68 to be plugged. If the device 60 also comprises a degradable material, then preferably the retainer material 82 degrades prior to the device material.

The material 82 could, in some examples, melt at elevated wellbore temperatures. The material 82 could be chosen to have a melting point that is between a temperature at the earth's surface and a temperature at the opening 68, so that the material melts during transport from the surface to the downhole location of the opening.

The material 82 could, in some examples, dissolve when exposed to wellbore fluid. The material 82 could be chosen so that the material begins dissolving as soon as it is deployed into the wellbore 14 and contacts a certain fluid (such as, water, brine, hydrocarbon fluid, etc.) therein. In other examples, the fluid that initiates dissolving of the material 82 could have a certain pH range that causes the material to dissolve.

Note that it is not necessary for the material 82 to melt or dissolve in the well. Various other stimuli (such as, passage of time, elevated pressure, flow, turbulence, etc.) could cause the material 82 to disperse, degrade or otherwise cease to retain the device 60. The material 82 could degrade in response to any one, or a combination, of: passage of a predetermined period of time in the well, exposure to a predetermined temperature in the well, exposure to a predetermined fluid in the well, exposure to radiation in the well and exposure to a predetermined chemical composition in the well. Thus, the scope of this disclosure is not limited to any particular stimulus or technique for dispersing or degrading the material 82, or to any particular type of material.

In some examples, the material 82 can remain on the device 60, at least partially, when the device engages the opening 68. For example, the material 82 could continue to cover the body 64 (at least partially) when the body engages and seals off the opening 68. In such examples, the material 82 could advantageously comprise a relatively soft, viscous and/or resilient material, so that sealing between the device 60 and the opening 68 is enhanced.

Suitable relatively low melting point substances that may be used for the material 82 can include wax (e.g., paraffin wax, vegetable wax), ethylene-vinyl acetate copolymer (e.g., ELVAX™ available from DuPont), atactic polypropylene, and eutectic alloys. Suitable relatively soft substances that may be used for the material 82 can include a soft silicone composition or a viscous liquid or gel.

Suitable dissolvable materials can include PLA, PGA, anhydrous boron compounds (such as anhydrous boric oxide and anhydrous sodium borate), polyvinyl alcohol, polyethylene oxide, salts and carbonates. The dissolution rate of a water-soluble polymer (e.g., polyvinyl alcohol, polyethylene oxide) can be increased by incorporating a water-soluble plasticizer (e.g., glycerin), or a rapidly-dissolving salt (e.g., sodium chloride, potassium chloride), or both a plasticizer and a salt.

In FIG. 7, the retainer 80 is in a cylindrical form. The device 60 is encapsulated in, or molded in, the retainer material 82. The fibers 62 and lines 66 are, thus, prevented from becoming entwined with the fibers and lines of any other devices 60.

In FIG. 8, the retainer 80 is in a spherical form. In addition, the device 60 is compacted, and its compacted shape is retained by the retainer material 82. A shape of the retainer 80 can be chosen as appropriate for a particular device 60 shape, in compacted or un-compacted form.

In FIG. 9, the retainer 80 is in a cubic form. Thus, any type of shape (polyhedron, spherical, cylindrical, etc.) may be used for the retainer 80, in keeping with the principles of this disclosure.

Figure 10:
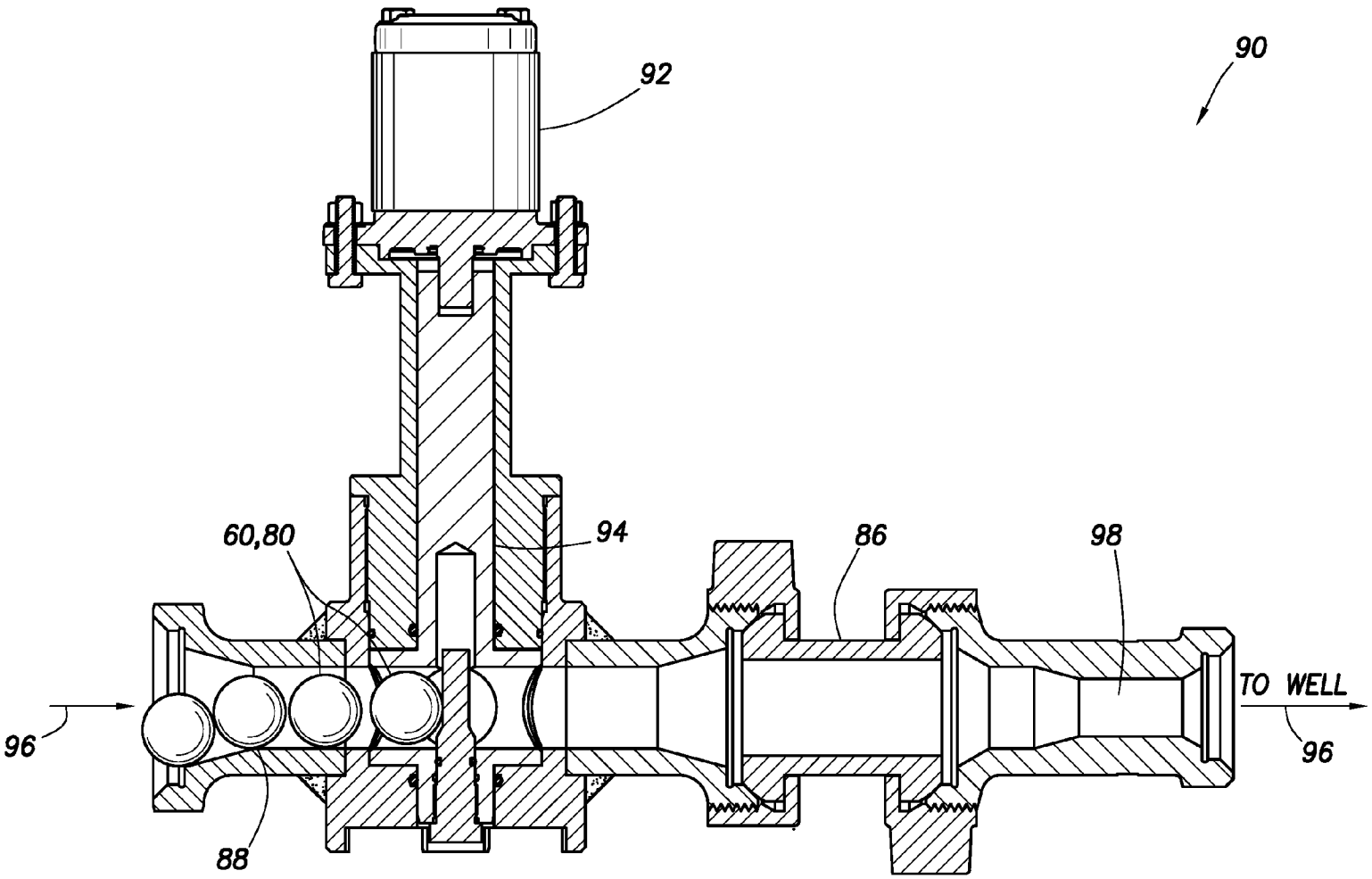
FIG. 10 is a representative cross-sectional view of an example of a deployment apparatus and method that can embody the principles of this disclosure.

Referring additionally now to FIG. 10, an example of a deployment apparatus 90 and an associated method are representatively illustrated. The apparatus 90 and method may be used with a system and method described herein, or they may be used with other systems and methods.

Figure 19:
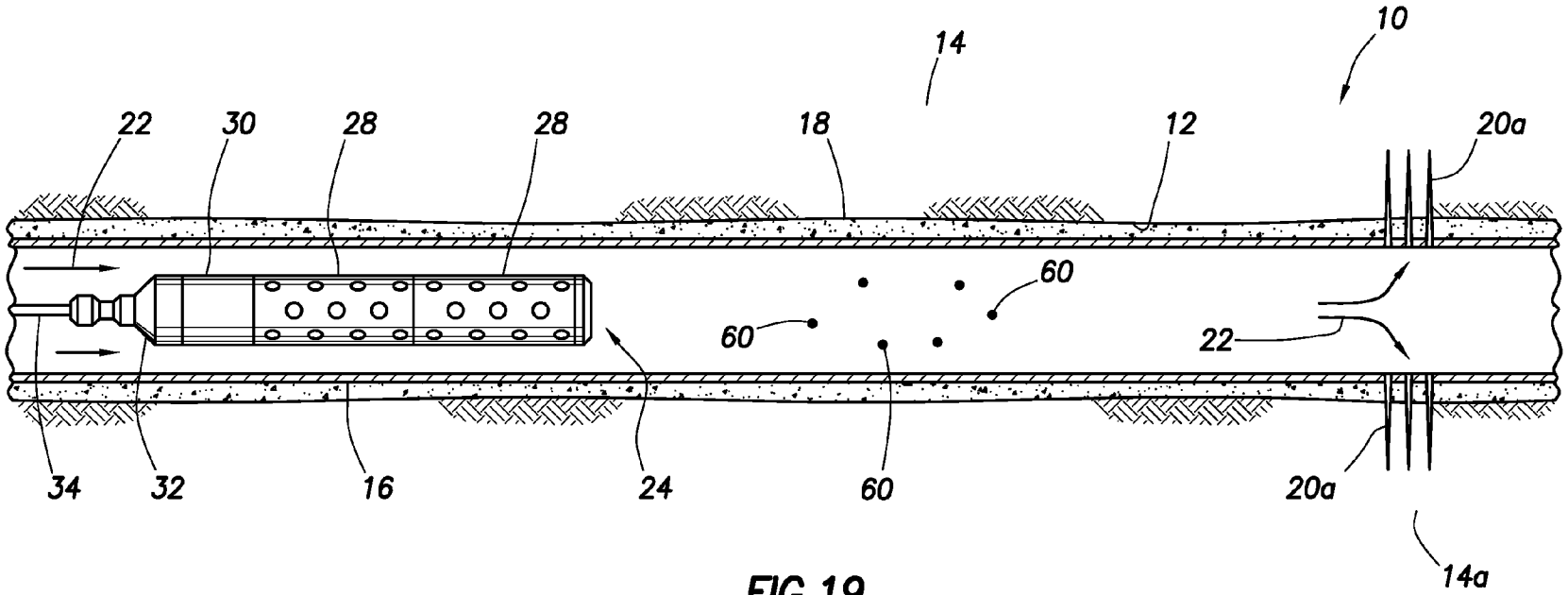
FIG. 19 is a representative partially cross-sectional view of another example of the system and method, wherein a perforating assembly and flow conveyed plugging devices are being displaced by fluid flow through a wellbore.
Figure 20:
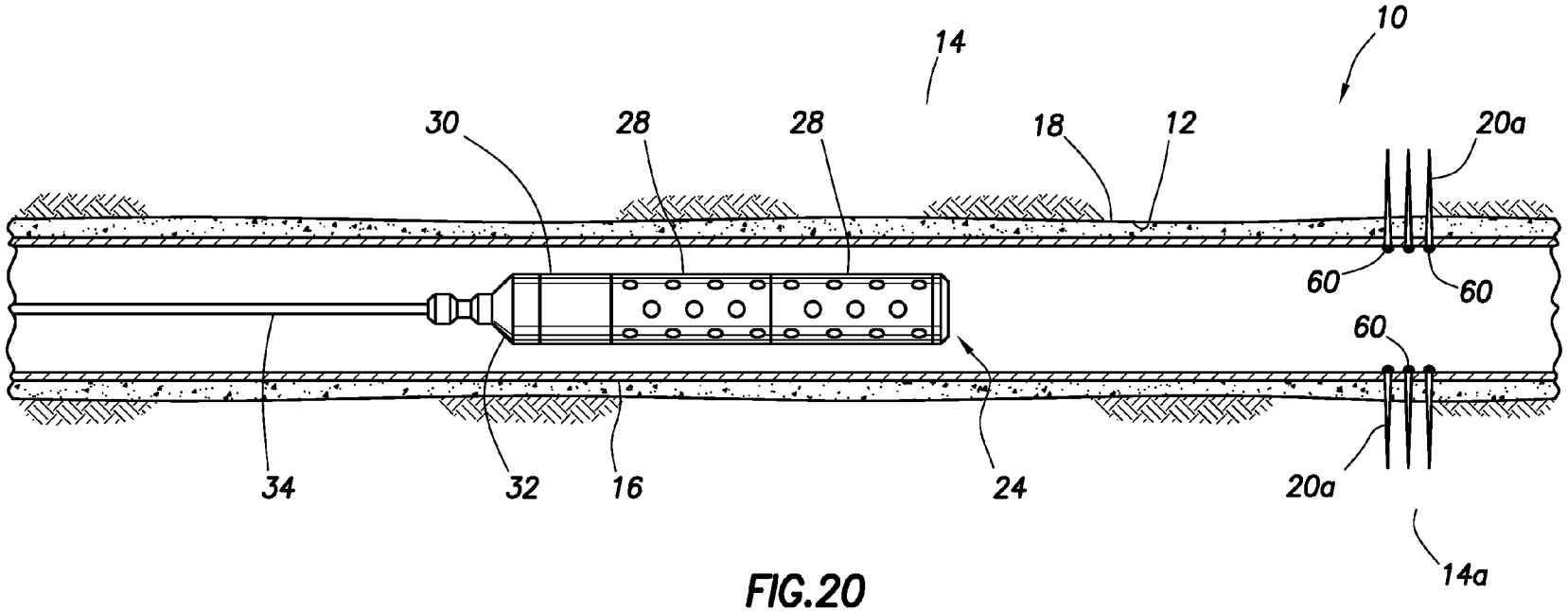
FIG. 20 is a representative partially cross-sectional view of the FIG. 19 system and method, wherein the flow conveyed plugging devices sealingly engage casing openings.
Figure 21:
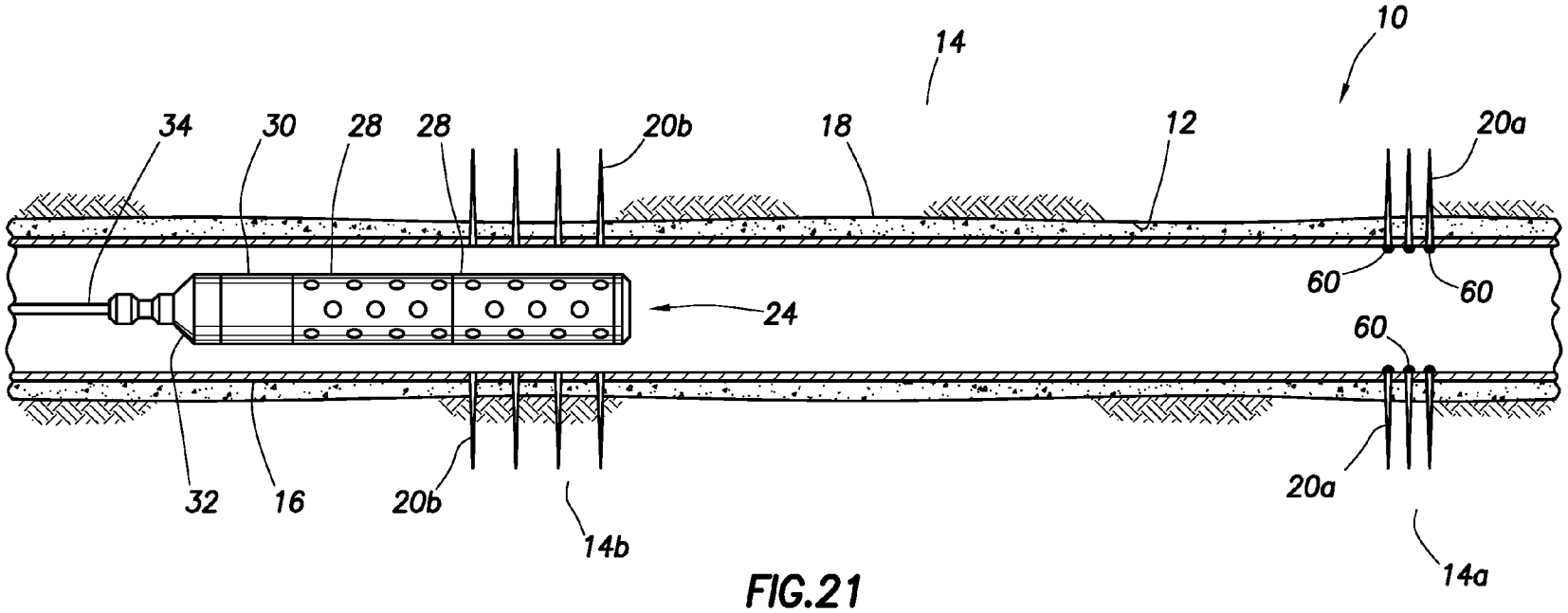
FIG. 21 is a representative partially cross-sectional view of the FIGS. 19 & 20 system and method, wherein additional perforations are formed with the perforating assembly.

When used with an example of the system 10 and method representatively illustrated in FIGS. 19-21, the apparatus 90 can be connected between a pump and the wellbore 12. However configured, an output of the apparatus 90 is connected to the well, although the apparatus itself may be positioned a distance away from the well.

The apparatus 90 is used in this example to deploy the devices 60 into the well. The devices 60 may or may not be retained by the retainer 80 when they are deployed. However, in the FIG. 10 example, the devices 60 are depicted with the retainers 80 in the spherical shape of FIG. 8, for convenience of deployment. The retainer material 82 can be at least partially dispersed during the deployment, so that the devices 60 are more readily conveyed by the flow 74.

In certain situations, it can be advantageous to provide a certain spacing between the devices 60 during deployment, for example, in order to efficiently plug casing perforations. One reason for this is that the devices 60 will tend to first plug perforations that are receiving highest rates of flow.

In addition, if the devices 60 are deployed downhole too close together, some of them can become trapped between perforations, thereby wasting some of the devices. The excess "wasted" devices 60 might later interfere with other well operations.

To mitigate such problems, the devices 60 can be deployed with a selected spacing. The spacing may be, for example, on the order of the length of the perforation interval. The apparatus 90 is desirably capable of deploying the devices 60 with any selected spacing between the devices.

Each device 60 in this example has the retainer 80 in the form of a dissolvable coating material with a frangible coating 88 thereon, to impart a desired geometric shape (spherical in this example), and to allow for convenient deployment. The dissolvable retainer material 82 could be detrimental to the operation of the device 60 if it increases a drag coefficient of the device. A high coefficient of drag can cause the devices 60 to be swept to a lower end of the perforation interval, instead of sealing uppermost perforations.

The frangible coating 88 is used to prevent the dissolvable coating from dissolving during a queue time prior to deployment. Using the apparatus 90, the frangible coating 88 can be desirably broken, opened or otherwise damaged during the deployment process, so that the dissolvable coating is then exposed to fluids that can cause the coating to dissolve.

Examples of suitable frangible coatings include cementitious materials (e.g., plaster of Paris) and various waxes (e.g., paraffin wax, carnauba wax, vegetable wax, machinable wax). The frangible nature of a wax coating can be optimized for particular conditions by blending a less brittle wax (e.g., paraffin wax) with a more brittle wax (e.g., carnauba wax) in a certain ratio selected for the particular conditions.

As depicted in FIG. 10, the apparatus 90 includes a rotary actuator 92 (such as, a hydraulic or electric servo motor, with or without a rotary encoder). The actuator 92 rotates a sequential release structure 94 that receives each device 60 in turn from a queue of the devices, and then releases each device one at a time into a conduit 86 that is connected to the tubular string 72 (or the casing 16).

Note that it is not necessary for the actuator 92 to be a rotary actuator, since other types of actuators (such as, a linear actuator) may be used in other examples. In addition, it is not necessary for only a single device 60 to be deployed at a time. In other examples, the release structure 94 could be configured to release multiple devices at a time. Thus, the scope of this disclosure is not limited to any particular details of the apparatus 90 or the associated method as described herein or depicted in the drawings.

In the FIG. 10 example, a rate of deployment of the devices 60 is determined by an actuation speed of the actuator 92. As a speed of rotation of the structure 94 increases, a rate of release of the devices 60 from the structure accordingly increases. Thus, the deployment rate can be conveniently adjusted by adjusting an operational speed of the actuator 92. This adjustment could be automatic, in response to well conditions, stimulation treatment parameters, flow rate variations, etc.

As depicted in FIG. 10, a liquid flow 96 enters the apparatus 90 from the left and exits on the right (for example, at about 1 barrel per minute). Note that the flow 96 is allowed to pass through the apparatus 90 at any position of the release structure 94 (the release structure is configured to permit flow through the structure at any of its positions).

When the release structure 94 rotates, one or more of the devices 60 received in the structure rotates with the structure. When a device 60 is on a downstream side of the release structure 94, the flow 96 though the apparatus 90 carries the device to the right (as depicted in FIG. 10) and into a restriction 98.

The restriction 98 in this example is smaller than the diameter of the device 60. The flow 96 causes the device 60 to be forced through the restriction 98, and the frangible coating 88 is thereby damaged, opened or fractured to allow the inner dissolvable material 82 of the retainer 80 to dissolve.

Other ways of opening, breaking or damaging a frangible coating may be used in keeping with the principles of this disclosure. For example, cutters or abrasive structures could contact an outside surface of a device 60 to penetrate, break, abrade or otherwise damage the frangible coating 88. Thus, this disclosure is not limited to any particular technique for damaging, breaking, penetrating or otherwise compromising a frangible coating.

Figure 11:
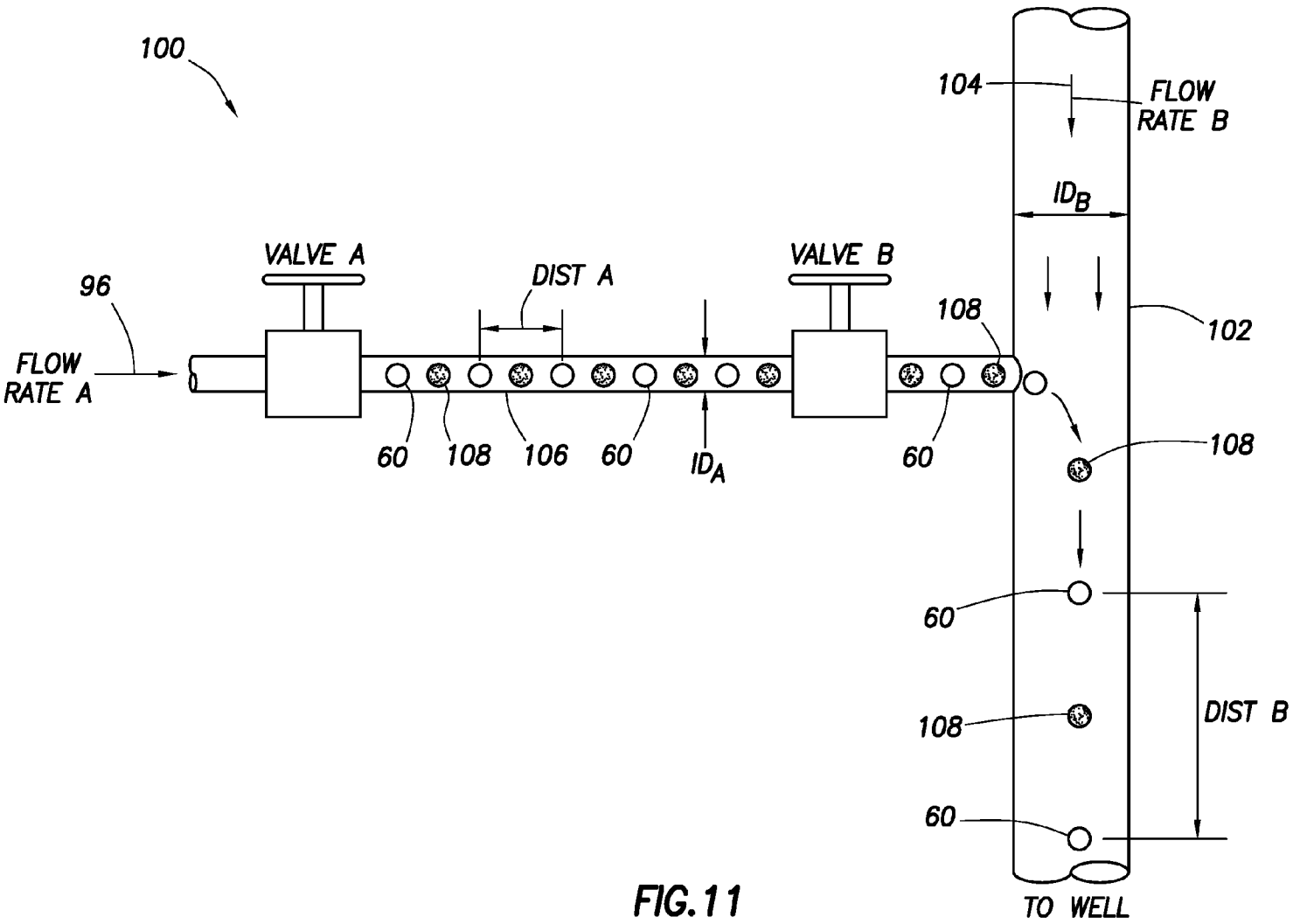
FIG. 11 is a representative schematic view of another example of a deployment apparatus and method that can embody the principles of this disclosure.

Referring additionally now to FIG. 11, another example of a deployment apparatus 100 and an associated method are representatively illustrated. The apparatus 100 and method may be used with a system and method described herein, or they may be used with other systems and methods.

In the FIG. 11 example, the devices 60 are deployed using two flow rates. Flow rate A through two valves (valves A & B) is combined with Flow rate B through a pipe 102 depicted as being vertical in FIG. 11 (the pipe may be horizontal or have any other orientation in actual practice).

The pipe 102 may be associated with a pump at the surface. In some examples, a separate pump (not shown) may be used to supply the flow 96 through the valves A & B.

Valve A is not absolutely necessary, but may be used to control a queue of the devices 60. When valve B is open the flow 96 causes the devices 60 to enter the vertical pipe 102. Flow 104 through the vertical pipe 102 in this example is substantially greater than the flow 96 through the valves A & B (that is, flow rate B>>flow rate A), although in other examples the flows may be substantially equal or otherwise related.

A spacing (dist. B) between the devices 60 when they are deployed into the well can be calculated as follows: dist. B=dist. A*($ID_A^2/ID_B^2$)*(flow rate B/flow rate A), where dist. A is a spacing between the devices 60 prior to entering the pipe 102, $ID_A$ is an inner diameter of a pipe 106 connected to the pipe 102, and $ID_B$ is an inner diameter of the pipe 102. This assumes circular pipes 102, 106. Where corresponding passages are non-circular, the term $ID_A^2/ID_B^2$ can be replaced by an appropriate ratio of passage areas.

The spacing between the plugging devices 60 in the well (dist. B) can be automatically controlled by varying one or both of the flow rates A, B. For example, the spacing can be increased by increasing the flow rate B or decreasing the flow rate A. The flow rate(s) A, B can be automatically adjusted in response to changes in well conditions, stimulation treatment parameters, flow rate variations, etc.

In some examples, flow rate A can have a practical minimum of about ½ barrel per minute. In some circumstances, the desired deployment spacing (dist. B) may be greater than what can be produced using a convenient spacing dist. A of the devices 60 and the flow rate A in the pipe 106.

The deployment spacing B may be increased by adding spacers 108 between the devices 60 in the pipe 106. The spacers 108 effectively increase the distance A between the devices 60 in the pipe 106 (and, thus, increase the value of dist. A in the equation above).

The spacers 108 may be dissolvable or otherwise dispersible, so that they dissolve or degrade when they are in the pipe 102 or thereafter. In some examples, the spacers 108 may be geometrically the same as, or similar to, the devices 60.

Note that the apparatus 100 may be used in combination with the restriction 98 of FIG. 10 (for example, with the restriction 98 connected downstream of the valve B but upstream of the pipe 102). In this manner, a frangible or other protective coating on the devices 60 and/or spacers 108 can be opened, broken or otherwise damaged prior to the devices and spacers entering the pipe 102.

Figure 12:
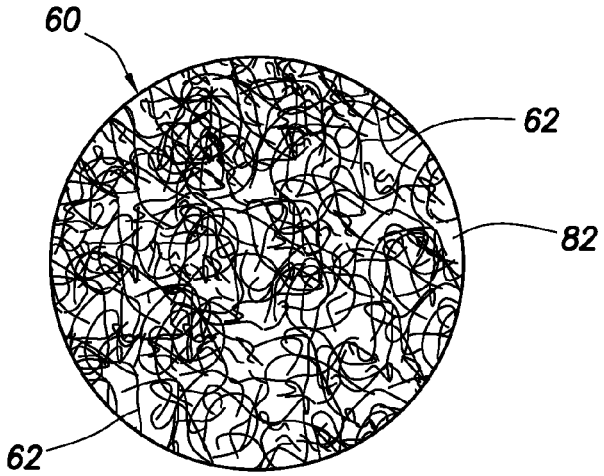
FIGS. 12 & 13 are representative cross-sectional views of additional examples of the flow conveyed plugging device.

Referring additionally now to FIG. 12, a cross-sectional view of another example of the device 60 is representatively illustrated. The device 60 may be used in any of the systems and methods described herein, or may be used in other systems and methods.

In this example, the body of the device 60 is made up of filaments or fibers 62 formed in the shape of a ball or sphere. Of course, other shapes may be used, if desired.

The filaments or fibers 62 may make up all, or substantially all, of the device 60. The fibers 62 may be randomly oriented, or they may be arranged in various orientations as desired.

In the FIG. 12 example, the fibers 62 are retained by the dissolvable, degradable or dispersible material 82. In addition, a frangible coating may be provided on the device 60, for example, in order to delay dissolving of the material 82 until the device has been deployed into a well (as in the example of FIG. 10).

The device 60 of FIG. 12 can be used in a diversion fracturing operation (in which perforations receiving the most fluid are plugged to divert fluid flow to other perforations), in a re-completion operation, or in a multiple zone perforate and treat operation.

One advantage of the FIG. 12 device 60 is that it is capable of sealing on irregularly shaped openings, perforations, leak paths or other passageways. The device 60 can also tend to "stick" or adhere to an opening, for example, due to engagement between the fibers 62 and structure surrounding (and in) the opening. In addition, there is an ability to selectively seal openings.

The fibers 62 could, in some examples, comprise wool fibers. The device 60 may be reinforced (e.g., using the material 82 or another material) or may be made entirely of fibrous material with a substantial portion of the fibers 62 randomly oriented.

The fibers 62 could, in some examples, comprise metal wool, or crumpled and/or compressed wire. Wool may be retained with wax or other material (such as the material 82) to form a ball, sphere, cylinder or other shape.

In the FIG. 12 example, the material 82 can comprise a wax (or eutectic metal or other material) that melts at a selected predetermined temperature. A wax device 60 may be reinforced with fibers 62, so that the fibers and the wax (material 82) act together to block a perforation or other passageway.

The selected melting point can be slightly below a static wellbore temperature. The wellbore temperature during fracturing or other stimulation treatment is typically depressed due to relatively low temperature fluids entering wellbore. After treatment, wellbore temperature will typically increase, thereby melting the wax and releasing the reinforcement fibers 62.

A drag coefficient of the device 60 in any of the examples described herein may be modified appropriately to produce a desired result. For example, in a diversion fracturing operation, it is typically desirable to block perforations in a certain location in a wellbore. The location is usually at the perforations taking the most fluid.

Natural fractures in an earth formation penetrated by the wellbore make it so that certain perforations receive a larger portion of treatment fluids. For these situations and others, the device 60 shape, size, density and other characteristics can be selected, so that the device tends to be conveyed by flow to a certain corresponding section of the wellbore.

For example, devices 60 with a larger coefficient of drag (Cd) may tend to seat more toward a toe of a generally horizontal or lateral wellbore. Devices 60 with a smaller Cd may tend to seat more toward a heel of the wellbore.

Figure 13:
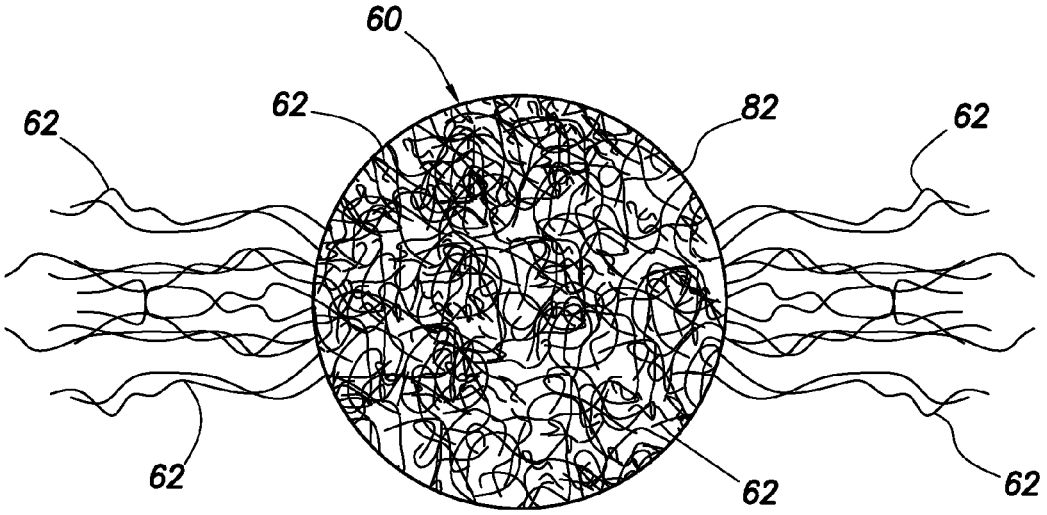

Smaller devices 60 with long fibers 62 floating freely (see the example of FIG. 13) may have a strong tendency to seat at or near the heel. A diameter of the device 60 and the free fiber 62 length can be appropriately selected, so that the device is more suited to stopping and sealingly engaging perforations anywhere along the length of the wellbore.

Acid treating operations can benefit from use of the device 60 examples described herein. Pumping friction causes hydraulic pressure at the heel to be considerably higher than at the toe. This means that the fluid volume pumped into a formation at the heel will be considerably higher than at the toe. Turbulent fluid flow increases this effect. Gelling additives might reduce an onset of turbulence and decrease the magnitude of the pressure drop along the length of the wellbore.

Higher initial pressure at the heel allows zones to be treated and then plugged starting at the heel, and then progressively down along the wellbore. This mitigates waste of acid from attempting to acidize all of the zones at the same time.

The free fibers 62 of the FIGS. 4-6B & 13 examples greatly increase the ability of the device 60 to engage the first open perforation (or other leak path) it encounters. Thus, the devices 60 with low Cd and long fibers 62 can be used to plug from upper perforations to lower perforations, while turbulent acid with high frictional pressure drop is used so that the acid treats the unplugged perforations nearest the top of the wellbore with acid first.

In examples of the device 60 where a wax material (such as the material 82) is used, the fibers 62 (including the body 64, lines 66, knots, etc.) may be treated with a treatment fluid that repels wax (e.g., during a molding process). This may be useful for releasing the wax from the fibrous material after fracturing or otherwise compromising the retainer 80 and/or a frangible coating thereon.

Suitable release agents are water-wetting surfactants (e.g., alkyl ether sulfates, high hydrophilic-lipophilic balance (HLB) nonionic surfactants, betaines, alkyarylsulfonates, alkyldiphenyl ether sulfonates, alkyl sulfates). The release fluid may also comprise a binder to maintain the knot or body 64 in a shape suitable for molding. One example of a binder is a polyvinyl acetate emulsion.

Broken-up or fractured devices 60 can have lower Cd. Broken-up or fractured devices 60 can have smaller cross-sections and can pass through restrictions in the well more readily.

The restriction 98 (see FIG. 10) may be connected in any line or pipe that the devices 60 are pumped through, in order to cause the devices to fracture as they pass through the restriction. This may be used to break up and separate devices 60 into wax and non-wax parts. The restriction 98 may also be used for rupturing a frangible coating covering a soluble wax material 82 to allow water or other well fluids to dissolve the wax.

Fibers 62 may extend outwardly from the device 60, whether or not the body 64 or other main structure of the device also comprises fibers. For example, a ball (or other shape) made of any material could have fibers 62 attached to and extending outwardly therefrom. Such a device 60 will be better able to find and cling to openings, holes, perforations or other leak paths near the heel of the wellbore, as compared to the ball (or other shape) without the fibers 62.

For any of the device 60 examples described herein, the fibers 62 may not dissolve, disperse or otherwise degrade in the well. In such situations, the devices 60 (or at least the fibers 62) may be removed from the well by swabbing, scraping, circulating, milling or other mechanical methods.

In situations where it is desired for the fibers 62 to dissolve, disperse or otherwise degrade in the well, nylon is a suitable acid soluble material for the fibers. Nylon 6 and nylon 66 are acid soluble and suitable for use in the device 60. At relatively low well temperatures, nylon 6 may be preferred over nylon 66, because nylon 6 dissolves faster or more readily.

Self-degrading fiber devices 60 can be prepared from poly-lactic acid (PLA), poly-glycolic acid (PGA), or a combination of PLA and PGA fibers 62. Such fibers 62 may be used in any of the device 60 examples described herein.

Fibers 62 can be continuous monofilament or multifilament, or chopped fiber. Chopped fibers 62 can be carded and twisted into yarn that can be used to prepare fibrous flow conveyed devices 60.

PLA and/or PGA fibers 62 may be coated with a protective material, such as calcium stearate, to slow its reaction with water and thereby delay degradation of the device 60. Different combinations of PLA and PGA materials may be used to achieve corresponding different degradation times or other characteristics.

PLA resin can be spun into fiber of 1-15 denier, for example. Smaller diameter fibers 62 will degrade faster. Fiber denier of less than 5 may be most desirable. PLA resin is commercially available with a range of melting points (e.g., 140 to 365° F.). Fibers 62 spun from lower melting point PLA resin can degrade faster.

PLA bi-component fiber has a core of high-melting point PLA resin and a sheath of low-melting point PLA resin (e.g., 140° F. melting point sheath on a 265° F. melting point core). The low-melting point resin can hydrolyze more rapidly and generate acid that will accelerate degradation of the high-melting point core. This may enable the preparation of a plugging device 60 that will have higher strength in a wellbore environment, yet still degrade in a reasonable time.

In various examples, a melting point of the resin can decrease in a radially outward direction in the fiber.

Referring additionally now to FIGS. 14-18, a variety of examples of the dispensing tool 26 are representatively illustrated. These dispensing tool 26 examples may be used with the system 10 and method of FIGS. 1-3, or they may be used with other systems and methods.

Figure 14:
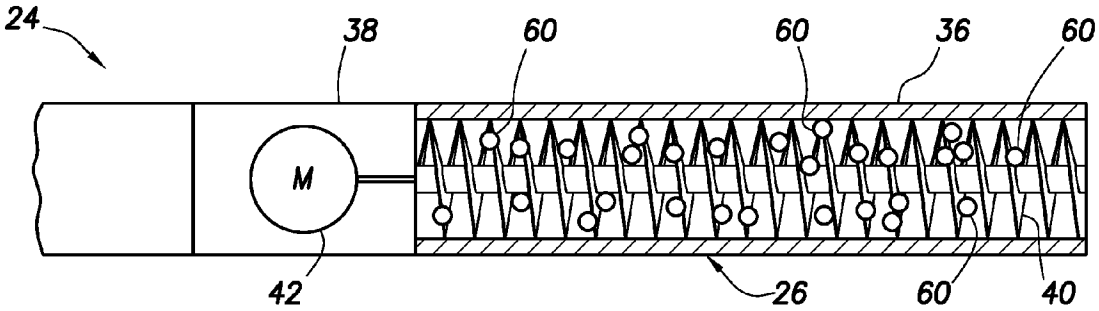
FIGS. 14-18 are representative partially cross-sectional view of examples of a dispensing tool that can be used with the system and method.

In the FIG. 14 example, the dispensing tool 26 includes the container 36 with an auger 40 therein. The auger 40 can be rotated by a motor 42 of the actuator 38.

When the auger 40 is rotated, plugging devices 60 are dispensed from the container 36. A rate of dispensing the plugging devices 60 can be controlled by varying a rotational speed of the auger 40, and a total number of plugging devices dispensed can be controlled by varying a duration of the auger rotation.

Figure 15:
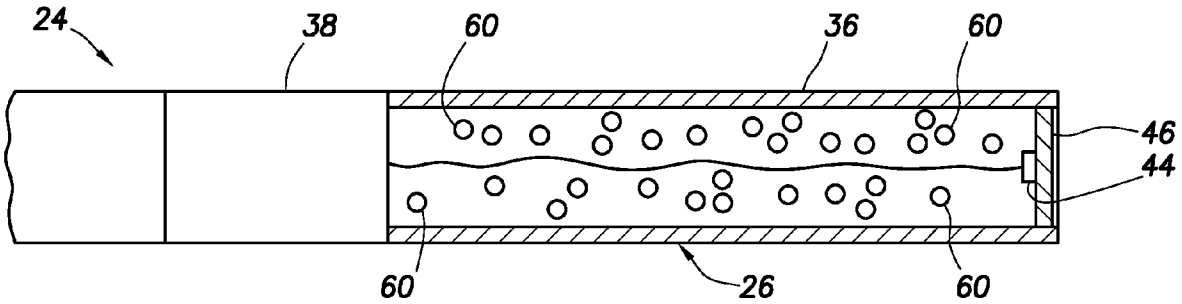

In the FIG. 15 example, the dispensing tool 26 includes a detonator 44 or other explosive device attached to or proximate a frangible closure 46 of the container 36.

The actuator 38 controls detonation of the detonator 44. When the detonator 44 is detonated, the closure 46 breaks and allows the plugging devices 60 to displace out of the container 36.

Figure 16:
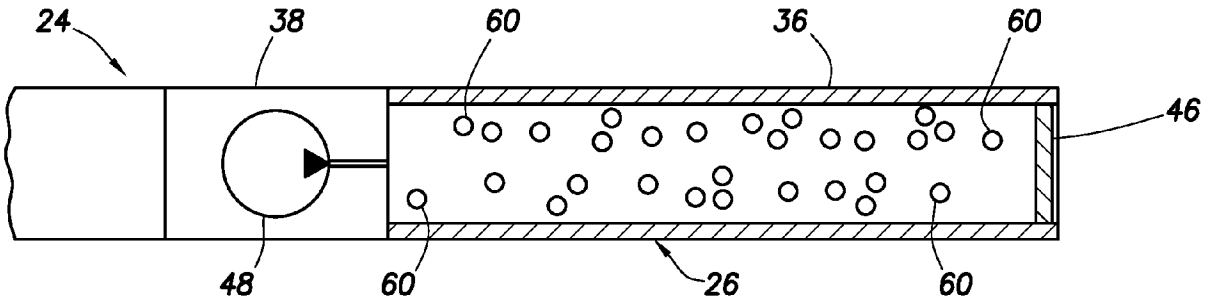

In the FIG. 16 example, the actuator 38 includes a hydraulic pump 48. The pump 48 is operated to increase pressure in the container 36. When the pressure in the container 36 has increased to a predetermined level, the frangible closure 46 breaks and the plugging devices 60 are expelled from the container.

Figure 17:
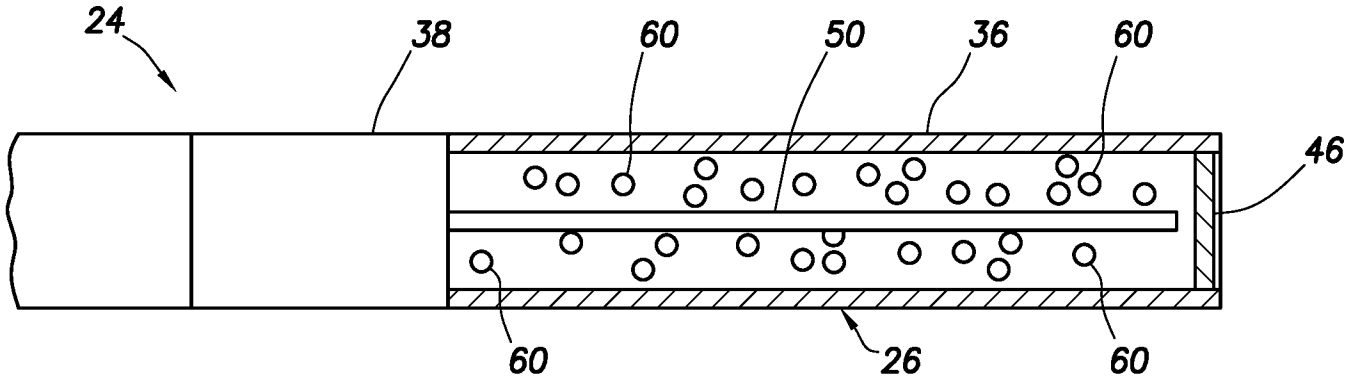

In the FIG. 17 example, the actuator 38 displaces an elongated member 50 (such as a rod) when it is desired to release the plugging devices 60 from the container 36. The member 50 impacts the frangible closure 46, so that it breaks and releases the plugging devices 60.

The actuator 38 could comprise any device capable of displacing the member 50. For example, a linear actuator, a propellant and piston, a jack screw or any other type of displacement device may be used in the actuator 38.

Figure 18:
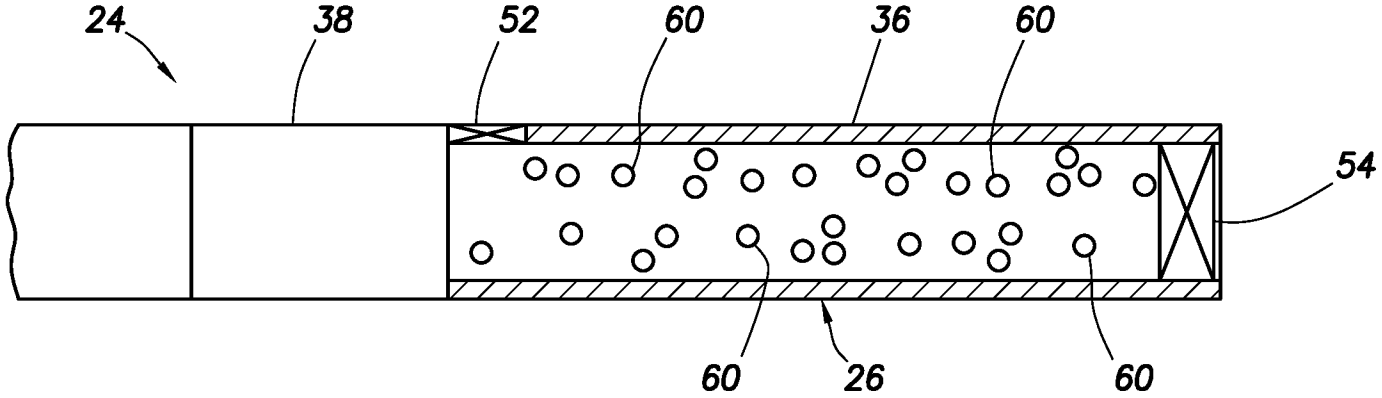

In the FIG. 18 example, the actuator 38 controls operation of two valves 52, 54. The valves 52, 54 provide for fluid flow through the container 36, so that the plugging devices 60 can be displaced out of the container with the flow. The valves 52, 54 can be located in any side or either end of the container 36.

Although only release of the plugging devices 60 from the container 36 is described herein and depicted in the drawings, other plugging substances, devices or materials may also be released downhole from the container 36 (or another container) into the wellbore 12 in other examples. A material (such as, calcium carbonate, PLA or PGA particles) may be released from the container 36 and conveyed by the flow 22 into any gaps between the devices 60 and the perforations or other openings to be plugged, so that a combination of the devices and the materials completely blocks flow through the openings.

Referring additionally now to FIGS. 19-21, another example of the system 10 and method is representatively illustrated. In this example, the perforating assembly 24 does not include the dispensing tool 26. Instead, the plugging devices 60 are dispensed into the wellbore 12 (for example, using the deployment apparatus 90 of FIG. 10 or the deployment apparatus 100 of FIG. 11), and then displaced therein with the perforating assembly 24.

In FIG. 19, the system 10 and method are depicted after the plugging devices 60 are dispensed into the wellbore 12 and the perforating assembly 24 is conveyed into the wellbore on the conveyance 34. The perforating assembly 24 and the plugging devices 60 are displaced through the wellbore 12 by the fluid flow 22.

The conveyance 34 can be used to stop the perforating assembly 24 at a desired location for forming additional perforations. Alternatively, the perforating assembly 24 can be displaced by the fluid flow 22 past the desired location, and then can be raised by the conveyance to the desired location to form the additional perforations.

In FIG. 20, the system 10 and method are depicted after the plugging devices 60 have sealingly engaged the perforations 20*a*. Although all of the perforations 20*a* are plugged as depicted in FIG. 20, one or more of the perforations may remain unplugged, for example, to allow continued fluid flow 22 through the wellbore 12, if desired.

In FIG. 21, the system 10 and method are depicted after the conveyance 34 has been used to raise the perforating assembly 24 to a desired location for forming additional perforations 20*b*. One of the perforators 28 has been used to form the perforations 20*b* through the casing 16 and cement 18, so that fluid communication is now permitted between a formation zone 14*b* and the interior of the casing.

The perforating assembly 24 may be displaced to other locations along the wellbore 12 for forming additional perforations, if desired. The perforating assembly 24 can then be retrieved from the wellbore 12, and the zone 14*b* (and any other perforated zone(s)) can be treated (for example, by fracturing, acidizing, injection of conformance agents, etc.).

The steps described above and depicted in FIGS. 19-21 can be repeated multiple times, until all desired zones have been perforated and treated. At that point, the plugging devices 60 can be degraded or otherwise removed from the perforations or other openings, so that fluid communication is permitted between the various zones and the interior of the casing 16.

Figure 22:
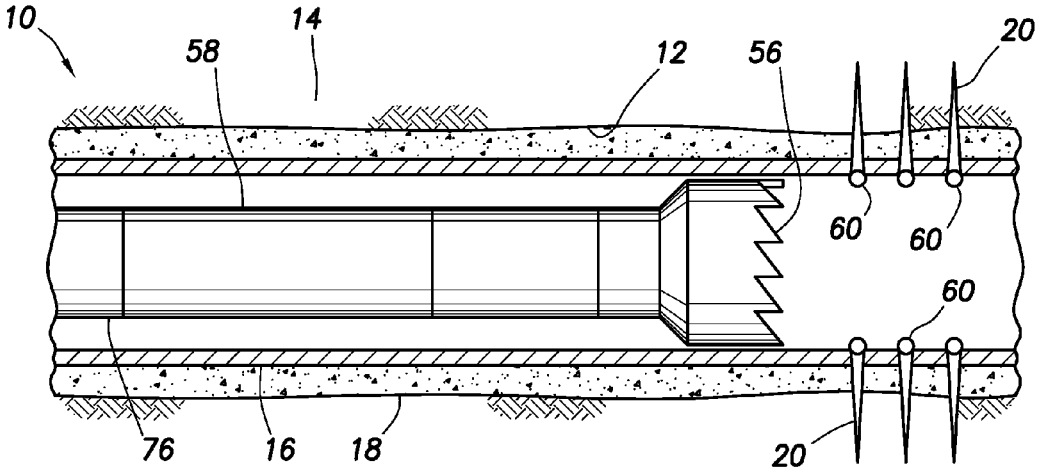
FIGS. 22-24 are representative partially cross-sectional views of example techniques for degrading or removing the plugging devices.
Figure 23:
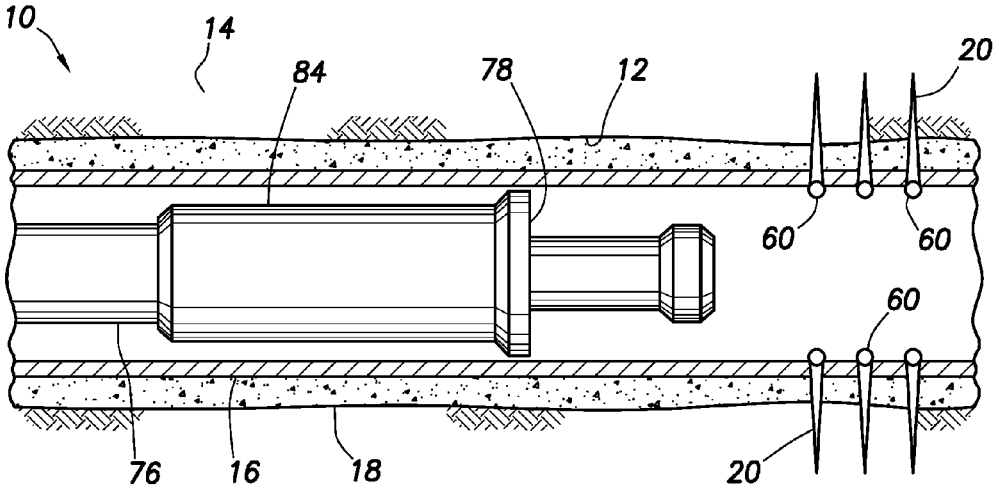
Figure 24:
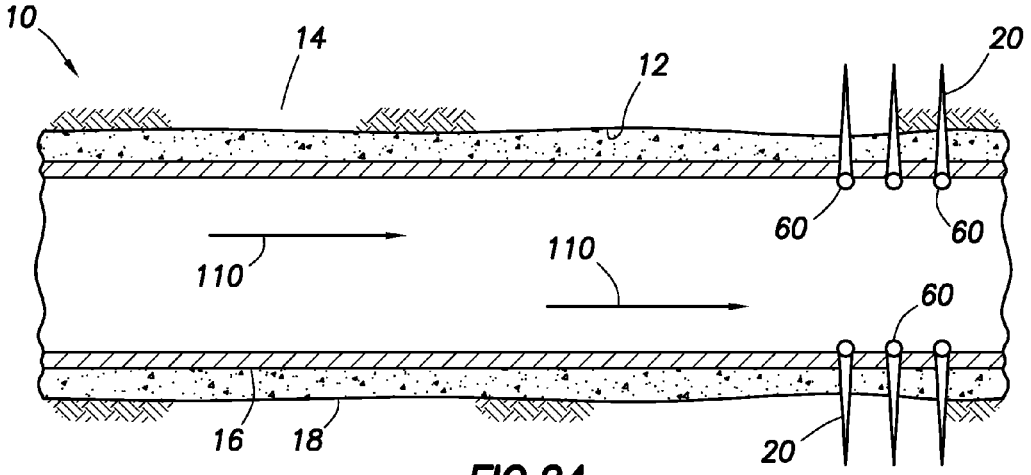

Referring additionally now to FIGS. 22-24, various examples of techniques for degrading or removing the plugging devices 60 from perforations 20 or other openings in a well are representatively illustrated. These techniques are depicted as being performed with the system 10 and method, but the techniques may be performed with other systems and methods, in keeping with the principles of this disclosure.

When used with the system 10 and method, the plugging devices 60 are degraded or removed after all zones 14*a,b* have been perforated and treated. Only one set of perforations 20 are depicted in FIGS. 22-24, but it should be understood that the depicted techniques can be used to degrade or remove the plugging devices 60 at any number of perforations or zones.

In the FIG. 22 example, a cutting device 56 (such as, a drill, mill, reamer, etc.) is used to cut into the plugging devices 60. The cutting device 56 may cut the plugging devices 60 from the perforations 20, or the cutting device may dislodge the plugging devices from the perforations.

A fluid motor 58 (such as, a turbine or a Moineau-type positive displacement fluid motor) may be used to rotate the cutting device 56 in response to fluid flow through a tubular string 76 extending to surface. Alternatively, or in addition, the tubular string 76 may be rotated from the surface. Note that it is not necessary for the cutting device 56 to be rotated, in keeping with the principles of this disclosure.

In the FIG. 23 example, a gauge ring 78 is used to dislodge the plugging devices 60 from the perforations 20. The gauge ring 78 is conveyed by the tubular string 76 in the depicted example, but a wireline or other conveyance may be used in other examples. A "junk basket" 84 may be included with the gauge ring 78 to retain the plugging devices 60 after they have been dislodged, for convenient retrieval to the surface.

In the FIG. 24 example, a degrading fluid 110 is flowed into contact with the plugging devices 60. The degrading fluid 110 could be an acid, or a fluid with a selected pH or other characteristic that causes or initiates degradation of the plugging devices 60. The degrading fluid 110 may be introduced into the casing 16, or a tubular string may be used to spot the degrading fluid 110 at the location(s) of the plugging devices 60.

It may now be fully appreciated that the above disclosure provides significant advancements to the art of controlling flow in subterranean wells. In some examples described above, the plugging device 60 may be used to block flow through openings in a well, with the device being uniquely configured so that its conveyance with the flow is enhanced and/or its sealing engagement with an opening is enhanced. In some examples, the plugging device 60 may be dispensed from a dispensing tool 26 included in a perforating assembly 24, or the plugging device may be displaced by fluid flow 22 through the wellbore 12 with the perforating assembly.

A well completion method, system and apparatus are described above, in which plugging devices 60 are released from a container 36 in a wellbore 12. The plugging devices 60 may be released to plug existing perforations 20*a*. The plugging devices 60 may be released prior to forming additional perforations 20*b* and fracturing through the additional perforations.

A well completion method, system and apparatus are described above, in which plugging devices 60 are released into a wellbore 12 ahead of a perforating assembly 24. The plugging devices 60 and the perforating assembly 24 may be pumped simultaneously through the wellbore 12.

The plugging devices 60 may plug perforations 20*a* existing before the perforating assembly 24 is introduced into the wellbore 12. The plugging devices 60 may plug perforations 20*b* made by the perforating assembly 24.

The plugging devices 60 may comprise a fibrous material, a degradable material, and/or a material selected from nylon, poly-lactic acid, poly-glycolic acid, poly-vinyl alcohol, poly-vinyl acetate and poly-methacrylic acid.

The plugging devices 60 may comprise a knot. The plugging devices 60 may comprise a fibrous material retained by a degradable retainer 80.

The above disclosure provides to the art a system 10 for use with a subterranean well. In one example, the system 10 can comprise a perforating assembly 24 including at least one perforator 28. The perforating assembly 24 is conveyed through a wellbore 24 with fluid flow 22 through the wellbore. Plugging devices 60 are spaced apart from the perforating assembly 24 in the wellbore 12. The plugging devices 60 are conveyed through the wellbore 12 with the fluid flow 22. The plugging devices 60 may be conveyed with the fluid flow 22 after being released from a container 36.

The plugging devices 60 may or may not be released from a container 36 of the perforating assembly 24. The perforating assembly 24 may include an actuator 38 configured to release the plugging devices 60 from the container 36.

Each of the plugging devices 60 may comprise a body 64 and, extending outwardly from the body, at least one of lines 66 and fibers 62. The lines 66 and/or fibers 62 may have a lateral dimension substantially less than a size of the body 64. The body 64 of each of the plugging devices 60 may comprise a knot.

Each of the plugging devices 60 may comprise a degradable material. The degradable material may be selected from poly-vinyl alcohol, poly-vinyl acetate, poly-methacrylic acid, poly-lactic acid and poly-glycolic acid.

The plugging devices 60 may be deployed into the wellbore 12 separate from the perforating assembly 24. The plugging devices 60 may be conveyed by the fluid flow 22 into sealing engagement with perforations 20, 20*a,b*.

A method of deploying plugging devices 60 in a wellbore 12 is also provided to the art by the above disclosure. In one example, the method can comprise: conveying a perforating assembly 24 including a dispensing tool 26 through the wellbore 12, the dispensing tool 26 including a container 36; and then releasing the plugging devices 60 from the container 36 into the wellbore 12 at a downhole location.

The releasing step can comprise operating an actuator 38 of the dispensing tool 26.

The method can include connecting a perforator 28 of the perforating assembly 24 between a conveyance 34 and the dispensing tool 26.

The method can include dislodging the plugging devices 60 from openings 68 (such as perforations 20, 20*a,b*), after the plugging devices 60 have sealingly engaged the openings.

The method can include cutting the plugging devices 60, after the plugging devices 60 have sealingly engaged openings 68 (such as perforations 20, 20*a,b*).

Another method of deploying plugging devices 60 in a wellbore 12 is provided by the above disclosure. In one example, the method can comprise: conveying the plugging devices 60 through the wellbore 12 with fluid flow 22 through the wellbore; and conveying a perforating assembly 24 through the wellbore 12 while the plugging devices 60 are being conveyed through the wellbore.

The step of conveying the perforating assembly 24 can include conveying the perforating assembly with the fluid flow 22 through the wellbore 12.

The method can include forming perforations 20*b* with the perforating assembly 24, after the plugging devices 60 sealingly engage openings 68 (such as perforations 20, 20*a,b*) downhole.

The method can include dislodging the plugging devices 60 from openings 68 (such as perforations 20, 20*a,b*), after the plugging devices 60 have sealingly engaged the openings.

The method can include cutting the plugging devices 60, after the plugging devices 60 have sealingly engaged openings 68 (such as perforations 20, 20*a,b*).

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a perforating assembly including at least one perforator, the perforating assembly conveyed through a wellbore with fluid flow through the wellbore, wherein the wellbore is free of any production string; and plugging devices spaced apart from the perforating assembly in the wellbore, the plugging devices conveyed through the wellbore with the fluid flow, wherein the plugging devices are released from a container of the perforating assembly, wherein the perforating assembly further includes an actuator configured to release the plugging devices from the container, and wherein each of the plugging devices comprises a body that is configured to engage an opening in a wall of a tubular string in the wellbore to substantially block fluid from flowing outward through the opening the body can engage the opening but is too large to pass through the opening and, extending outwardly from the body, at least one of the group consisting of lines and fibers.

2. The system of claim 1, wherein the at least one of the group consisting of lines and fibers has a lateral dimension substantially less than a size of the body.

3. The system of claim 1, wherein the body of each of the plugging devices comprises a knot.

4. A method of deploying plugging devices in a wellbore, the method comprising:

conveying a perforating assembly including a dispensing tool through the wellbore with fluid flow through the wellbore, the dispensing tool including a container, and the wellbore not including a production string; and then releasing the plugging devices from the container into the wellbore at a downhole location, wherein each of the plugging devices comprises a body that is configured to engage an opening in a wall of a tubular string in the wellbore to substantially block fluid from flowing outward through the opening, the body can engage the opening but is too large to pass through the opening and, extending outwardly from the body, at least one of the group consisting of lines and fibers.

5. The method of claim 4, wherein the at least one of the group consisting of lines and fibers has a lateral dimension substantially less than a size of the body.

6. The method of claim 4, wherein the body of each of the plugging devices comprises a knot.

7. A method of deploying plugging devices in a wellbore, the method comprising:

releasing the plugging devices from a dispensing tool into the wellbore;

conveying the plugging devices through the wellbore with fluid flow through the wellbore; and prior to the plugging devices engaging respective openings in the wellbore, conveying a perforating assembly through the wellbore while the plugging devices are being conveyed through the wellbore, wherein each of the plugging devices comprises a body and, extending outwardly from the body, at least one of the group consisting of lines and fibers.

8. The method of claim 7, wherein the at least one of the group consisting of lines and fibers has a lateral dimension substantially less than a size of the body.

9. The method of claim 7, wherein the body of each of the plugging devices comprises a knot.

* * * * *